US009697967B2

(12) United States Patent
Seo et al.

(10) Patent No.: US 9,697,967 B2
(45) Date of Patent: Jul. 4, 2017

(54) ROTARY KNOB ASSEMBLY CAPABLE OF UP-AND-DOWN MOTION

(71) Applicant: SAMSUNG ELECTRONICS CO., LTD., Suwon-si (KR)

(72) Inventors: Jae-kab Seo, Suwon-si (KR); Heyun-moon Bang, Suwon-si (KR); Jae-Yong Eum, Suwon-si (KR); Ho-sun Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 98 days.

(21) Appl. No.: 14/689,535

(22) Filed: Apr. 17, 2015

(65) Prior Publication Data

US 2015/0303009 A1 Oct. 22, 2015

(30) Foreign Application Priority Data

Apr. 17, 2014 (KR) ..... 10-2014-0045916

(51) Int. Cl.
*H01H 25/00* (2006.01)
*H01H 25/06* (2006.01)
(Continued)

(52) U.S. Cl.
CPC ..... *H01H 25/06* (2013.01); *G05G 1/087* (2013.01); *H01H 3/08* (2013.01); *H01H 7/03* (2013.01);
(Continued)

(58) Field of Classification Search
CPC ..... H01H 25/006; H01H 7/03; H01H 7/02; H01H 2003/085
(Continued)

(56) References Cited

U.S. PATENT DOCUMENTS 1,947,282 A * 2/1934 Theis ..... H01H 25/06 200/341
5,384,442 A * 1/1995 Danner ..... H01H 3/08 200/336
(Continued)

FOREIGN PATENT DOCUMENTS

DE 102009033903 A1 1/2011
EP 1528585 A2 5/2005
(Continued)

OTHER PUBLICATIONS

Search Report issued Jul. 14, 2015, issued by the International Searching Authority in counterpart International Patent Application No. PCT/KR2015/003474 (PCT/ISA/210).
(Continued)

*Primary Examiner* — Felix O Figueroa
(74) *Attorney, Agent, or Firm* — Sughrue Mion, PLLC

(57) ABSTRACT

A rotary knob assembly capable of up-and-down motion is provided. The rotary knob assembly includes a lower case with an oil damper; a rotary sleeve rotatably disposed in the lower case with a connecting hole; a slide cam that moves linearly with respect to the lower case with a pair of cam grooves and a sleeve hole; an elastic member disposed between the slide cam and the lower case; an up-and-down moving sleeve that moves up and down with respect to the rotary sleeve with a pair of up-and-down cams inserted in the pair of cam grooves of the slide cam; a rotary knob that is rotatably connected to the up-and-down moving sleeve; and an upper case connected to the lower case to limit vertical movement of the rotary knob, wherein a moving speed of the slide cam is controlled by the oil damper.

19 Claims, 21 Drawing Sheets

(51) Int. Cl.

| | |
|---|---|
| ***H01H 7/03*** | (2006.01) |
| ***G05G 1/08*** | (2006.01) |
| ***H01H 3/08*** | (2006.01) |
| ***H01H 19/04*** | (2006.01) |

(52) U.S. Cl.
CPC ..... *H01H 19/04* (2013.01); *H01H 2003/085* (2013.01); *H01H 2221/01* (2013.01)

(58) Field of Classification Search
USPC ..... 200/566, 564, 336
See application file for complete search history.

(56) References Cited

U.S. PATENT DOCUMENTS

| | | | | |
|---|---|---|---|---|
| 8,217,292 | B2 * | 7/2012 | Hamm | H01H 3/08 200/600 |
| 8,969,749 | B2 * | 3/2015 | Nishikawa | G05G 7/08 200/520 |
| 2007/0199806 | A1 | 8/2007 | Da Dalt et al. | |
| 2013/0139621 | A1 | 6/2013 | Nishikawa et al. | |
| 2014/0021024 | A1 | 1/2014 | Heimann et al. | |

FOREIGN PATENT DOCUMENTS

| | | | |
|---|---|---|---|
| JP | 2000-123684 | A | 4/2000 |
| KR | 2000-0033796 | A | 6/2000 |
| KR | 10-2005-0060831 | A | 6/2005 |

OTHER PUBLICATIONS

Written Opinion issued Jul. 14, 2015, issued by the International Searching Authority in counterpart International Patent Application No. PCT/KR2015/003474 (PCT/ISA/237).
Communication issued Sep. 17, 2015, issued by the European Patent Office in counterpart European Patent Application No. 15162749.4.
Communication dated Oct. 7, 2015, issued by the European Patent Office in counterpart European Application No. 15162749.4.

* cited by examiner

ROTARY KNOB ASSEMBLY CAPABLE OF UP-AND-DOWN MOTION

CROSS-REFERENCE TO RELATED APPLICATION(S)

This application claims priority from Korean Patent Application No. 10-2014-0045916, filed on Apr. 17, 2014, in the Korean Intellectual Property Office, the disclosure of which is incorporated herein by reference in its entirety.

BACKGROUND

1. Field

Apparatuses and methods consistent with exemplary embodiments relate to a rotary knob assembly, and more particularly, to a rotary knob assembly capable of a rotary motion and an up-and-down motion.

2. Description of the Related Art

Generally, acoustic devices such as audio players, and the like, have a volume controller for controlling a volume of sound. For example, three types of volume controllers may be used. The first type is a protruding type of volume controller, and is formed so that a rotary knob protrudes. In this example, a user can adjust the volume of sound by rotating or turning the rotary knob. Here, if the rotary knob is rotated in one direction, the volume of sound is increased, and if the rotary knob is rotated in the opposite direction, the volume of sound is reduced.

A second type of volume controller is a button type of volume controller which is typically provided with a sound up button and a sound down button which are separately formed. In this example, if the sound up button is pressed, the volume of sound is increased, and if the sound down button is pressed, the volume of sound is decreased.

A third type of volume controller is a touch type of volume controller which is used in acoustic devices that have a touch screen. Similar to the example of the button type of volume controller, a sound up button image and a sound down button image are displayed on the touch screen. In this example, when a user touches the sound up button image, the volume of sound is increased, and when the user touches the sound down button image, the volume of sound is decreased.

However, because the conventional volume controllers project outwardly or require the use of a touch screen, there is a limit in designing the acoustic device. Accordingly, a different type of volume controller is needed to increase the diversity of the design of the acoustic device.

SUMMARY

Exemplary embodiments overcome the above disadvantages and other disadvantages not described above. Also, an exemplary embodiment is not required to overcome the disadvantages described above, and an exemplary embodiment may not overcome any of the problems described above.

The exemplary embodiments relate to a rotary knob assembly capable of up-and-down motion in which, when not in use, the rotary knob may be accommodated within a device and does not protrude. Furthermore, when in use, the rotary knob can be projected by one-touch and a projecting motion of the rotary knob is smooth.

According to an aspect of an exemplary embodiment, there is provided a rotary knob assembly capable of up-and-down motion, including a lower case in which an oil damper is disposed; a rotary sleeve rotatably disposed with respect to the lower case, the rotary sleeve including a connecting hole; a slide cam that moves linearly with respect to the lower case, the slide cam including a pair of cam grooves which are inclined with respect to the lower case and a sleeve hole through which the rotary sleeve passes; an elastic member disposed between the slide cam and the lower case, the elastic member including a first end fixed to the lower case and a second end fixed to the slide cam; an up-and-down moving sleeve that moves up and down with respect to the rotary sleeve, the up-and-down moving sleeve including a pair of up-and-down cams that are inserted in the pair of cam grooves of the slide cam; a rotary knob that is rotatably connected to the up-and-down moving sleeve, the rotary knob including a connecting member that is inserted in the connecting hole of the rotary sleeve; and an upper case connected to an upper side of the lower case, the upper case being configured to limit up and down movement of the rotary knob, wherein a moving speed of the slide cam is controlled by the oil damper.

The rotary knob assembly may include an output variable element including a rotation shaft connected to a bottom end of the rotary sleeve; and a printed circuit board in which the output variable element is disposed, the printed circuit board being fixed to the lower case.

The output variable element may include a variable volume.

The oil damper may include a pinion gear; and an oil tank rotatably supporting the pinion gear, the oil tank being filled with oil, wherein a rotation speed of the pinion gear may be slowed by a viscosity resistance of the oil in the oil tank.

The slide cam may include a rack gear that is formed parallel to a moving direction of the slide cam and that is engaged with the pinion gear of the oil damper.

The rotary knob may include an upper rotary knob including a hollow cylindrical shape with a bottom, and a lower rotary knob including a hollow cylindrical shape, wherein the connecting member may be formed at a center of the bottom of the upper rotary knob, and the upper rotary knob may be detachably coupled to the lower rotary knob.

The lower rotary knob may include a flange that is caught by a bottom surface of the upper case.

The up-and-down moving sleeve may include a sleeve cap including a hollow cylindrical shape, the sleeve cap including a sleeve flange caught by a top end of the lower rotary knob; and a sleeve body including a hollow cylindrical shape, the sleeve body may be coupled to the sleeve cap, and the pair of up-and-down cams may be formed in a lower portion of a side surface of the sleeve body.

The rotary sleeve may include an upper rotary sleeve including the connecting hole and a receiving space in which the connecting member of the rotary knob is received; and a lower rotary sleeve coupled to the upper rotary sleeve and including a fixing groove in which a rotating object is inserted.

The rotary sleeve may be rotatably disposed in the lower case by a fixing ring.

A plurality of inclined teeth may be concentrically formed at a top end of the lower rotary sleeve.

The connecting hole of the upper rotary sleeve may include a central hole and a plurality of slots extending from the central hole, and the connecting member of the rotary knob may include a body inserted in the central hole and a plurality of ribs that extend from the body and are inserted in the slots.

A bottom surface of the upper rotary sleeve may include receiving grooves in which the ribs of the rotary knob are received.

The rotary knob assembly may include an elastic member which is disposed between the rotary knob and the rotary sleeve, and which elastically supports the rotary knob.

In response to the rotary knob being pressed once, the connecting member of the rotary knob may be caught by the rotary sleeve so that the rotary sleeve remains in a pressed state.

In response to the rotary knob being pressed again, the connecting member of the rotary knob may get out of the rotary sleeve and project to an original position.

The lower case may include a pair of supporting brackets to support an up and down movement of the up-and-down moving sleeve.

The lower case may include a push-push latch, and a secondary fixing hook which is coupled to or separated from the push-push latch according to a movement of the slide cam may be formed in the slide cam.

Other objects, advantages and salient features of the present disclosure will become apparent from the following detailed description, which, taken in conjunction with the annexed drawings, discloses the exemplary embodiments.

BRIEF DESCRIPTION OF THE DRAWINGS

These and/or other aspects and advantages of the present disclosure will become more apparent and more readily appreciated from the following description, taken in conjunction with the accompanying drawings, in which.

Throughout the drawings, like reference numerals will be understood to refer to like parts, components and structures.

DETAILED DESCRIPTION

Hereinafter, certain exemplary embodiments will be described in detail with reference to the accompanying drawings.

The matters defined herein, such as a detailed construction and elements thereof, are provided to assist a reader in a comprehensive understanding of the invention. Thus, it is apparent that one or more exemplary embodiments may be carried out without those specifically defined matters. Also, well-known functions and/or constructions may be omitted to provide a clear and concise description of the exemplary embodiments. Further, dimensions of various elements in the accompanying drawings may be arbitrarily increased or decreased for assisting in a comprehensive understanding.

Figure 1:
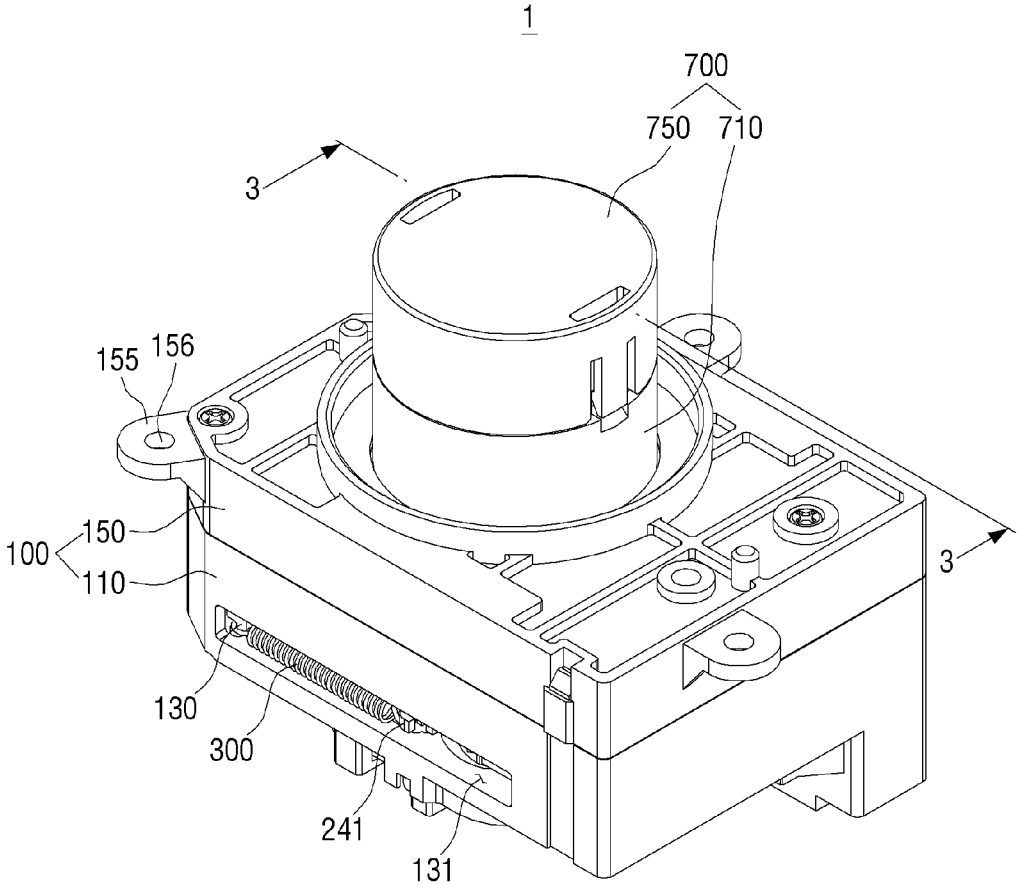
FIG. 1 is a diagram illustrating a rotary knob assembly capable of up-and-down motion according to an exemplary embodiment.
Figure 2:
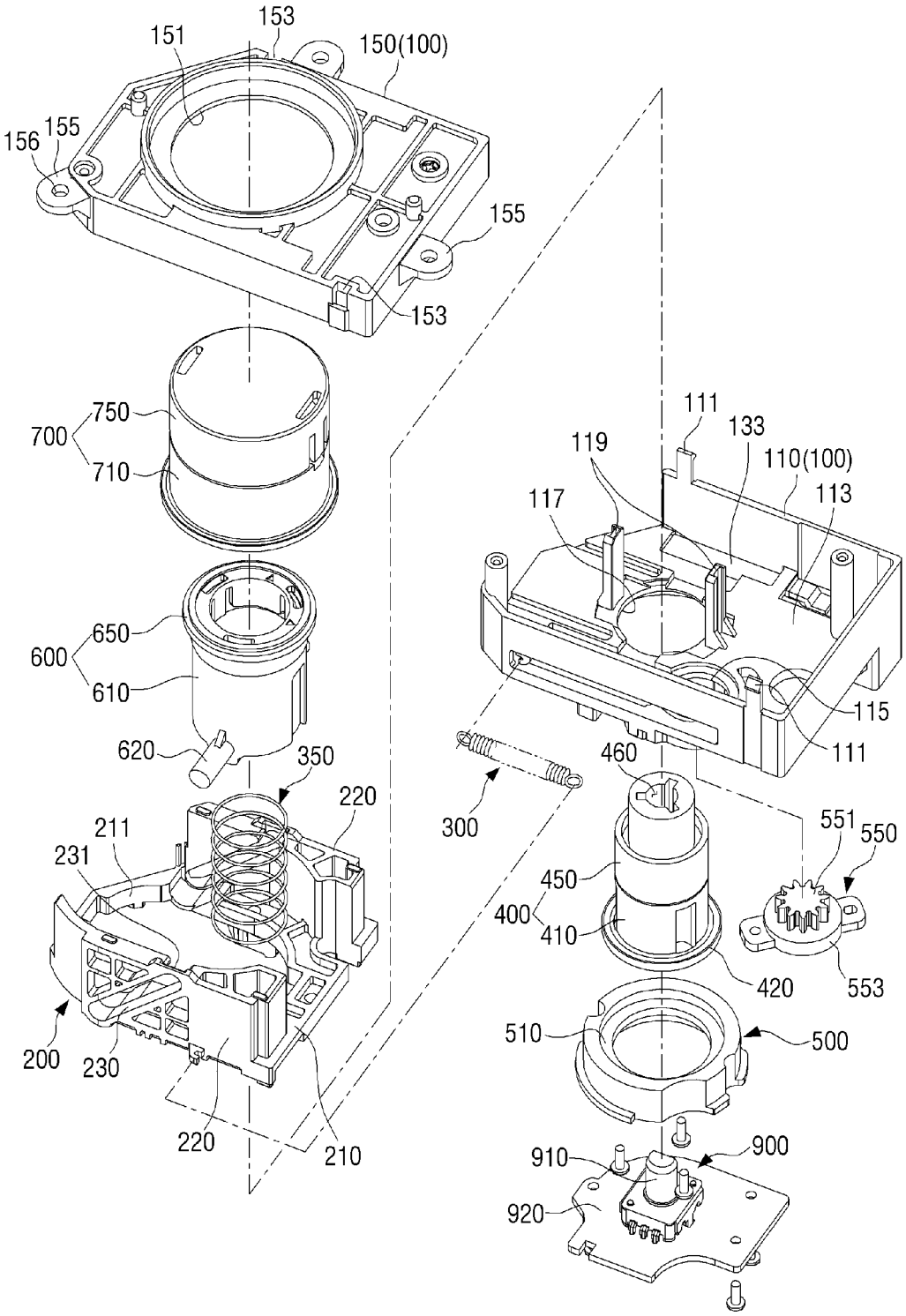
FIG. 2 is an exploded perspective view illustrating the rotary knob assembly capable of up-and-down motion of FIG. 1 according to an exemplary embodiment.
Figure 3:
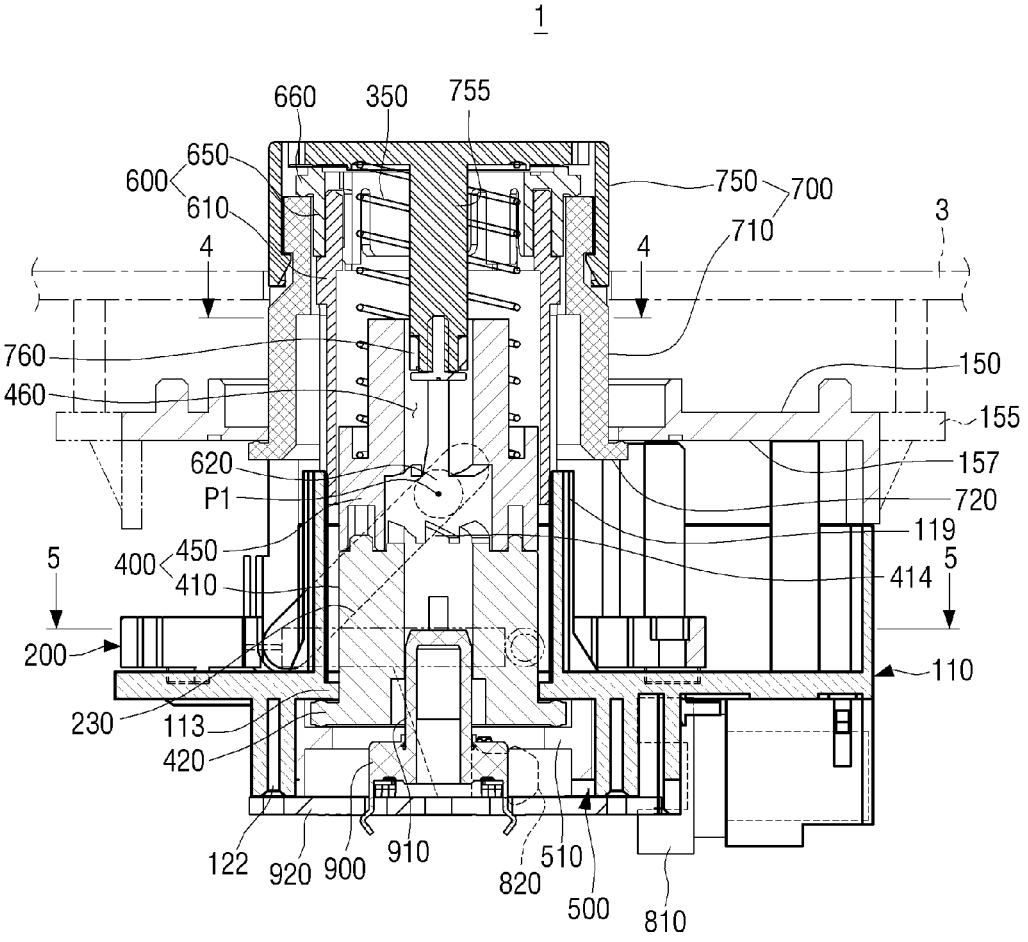
FIG. 3 is a cross-sectional view illustrating the rotary knob assembly capable of up-and-down motion taken along line 3-3 in FIG. 1, according to an exemplary embodiment.
Figure 4:
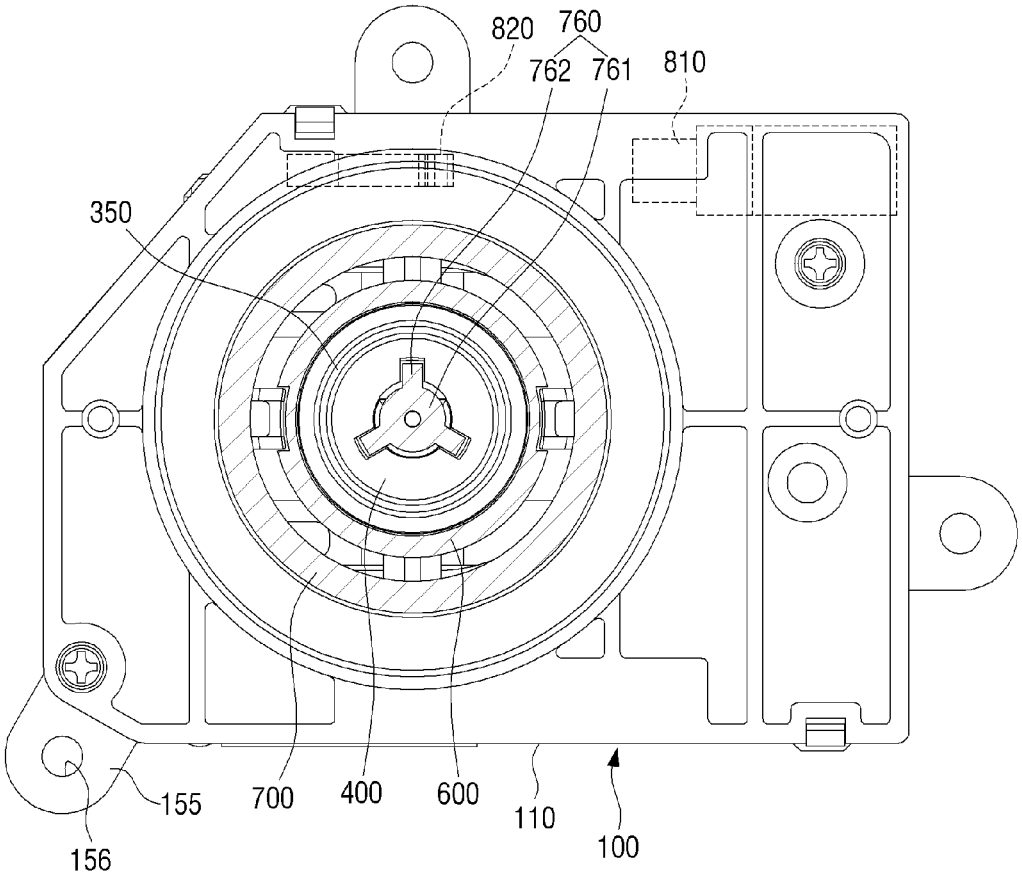
FIG. 4 is a cross-sectional view illustrating the rotary knob assembly capable of up-and-down motion taken along line 4-4 in FIG. 3, according to an exemplary embodiment.

FIG. 1 is a diagram illustrating a rotary knob assembly capable of up-and-down motion according to an exemplary embodiment, and FIG. 2 is an exploded perspective view illustrating the rotary knob assembly capable of up-and-down motion of FIG. 1. FIG. 3 is a cross-sectional view illustrating the rotary knob assembly capable of up-and-down motion taken along line 3-3 of FIG. 1, FIG. 4 is a cross-sectional view illustrating the rotary knob assembly capable of up-and-down motion taken along line 4-4 of FIG.

Figure 5:
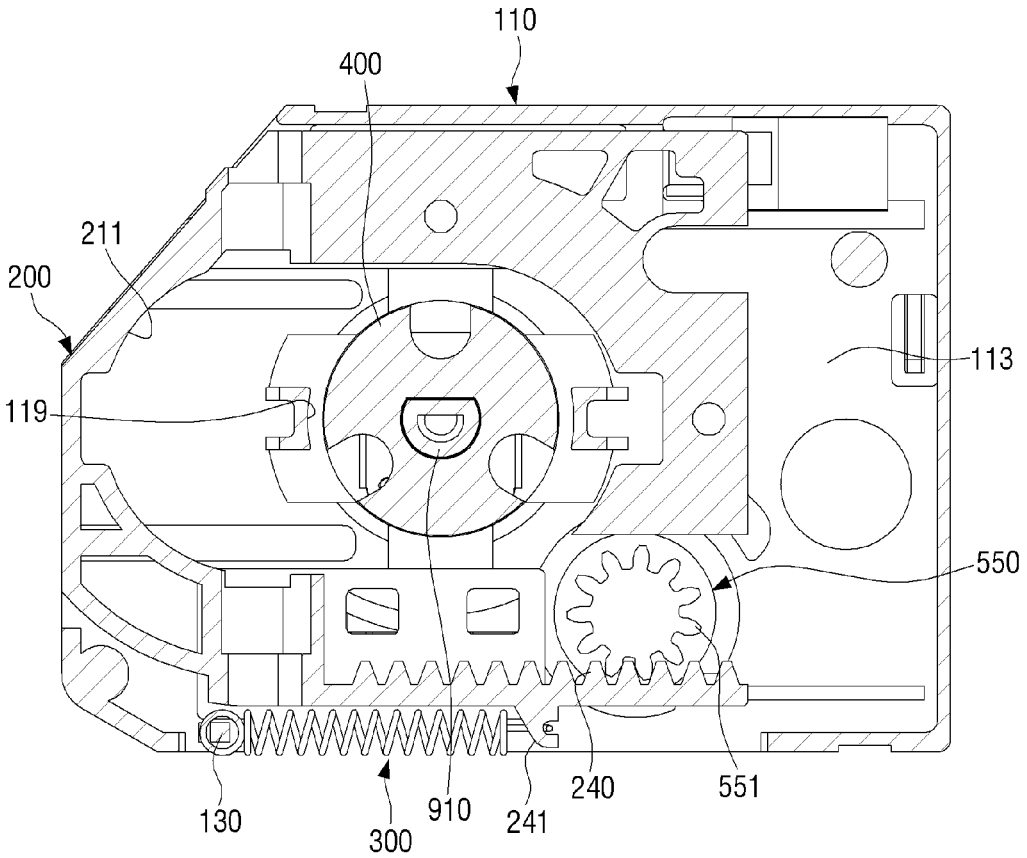
FIG. 5 is a cross-sectional view illustrating the rotary knob assembly capable of up-and-down motion taken along line 5-5 in FIG. 3, according to an exemplary embodiment.
Figure 6:
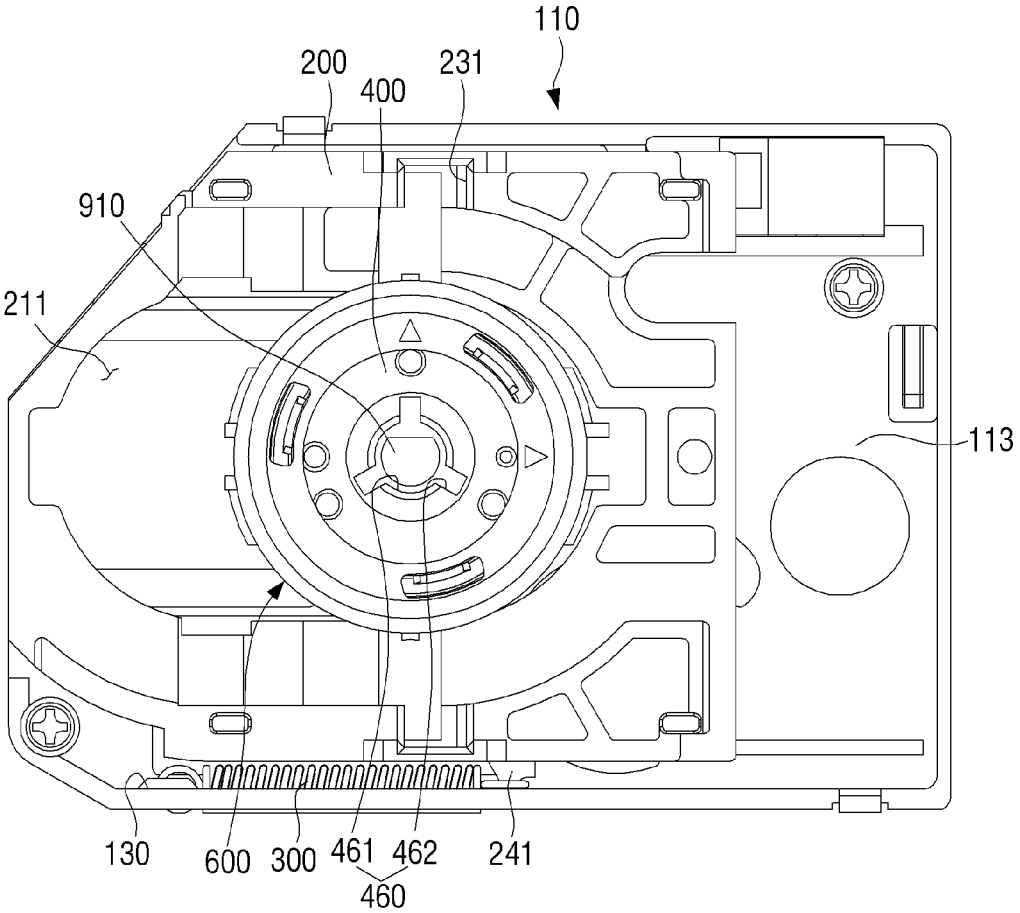
FIG. 6 is a diagram illustrating the rotary knob assembly capable of up-and-down motion of FIG. 1 from which an upper case and a rotary knob are removed, according to an exemplary embodiment.
Figure 7:
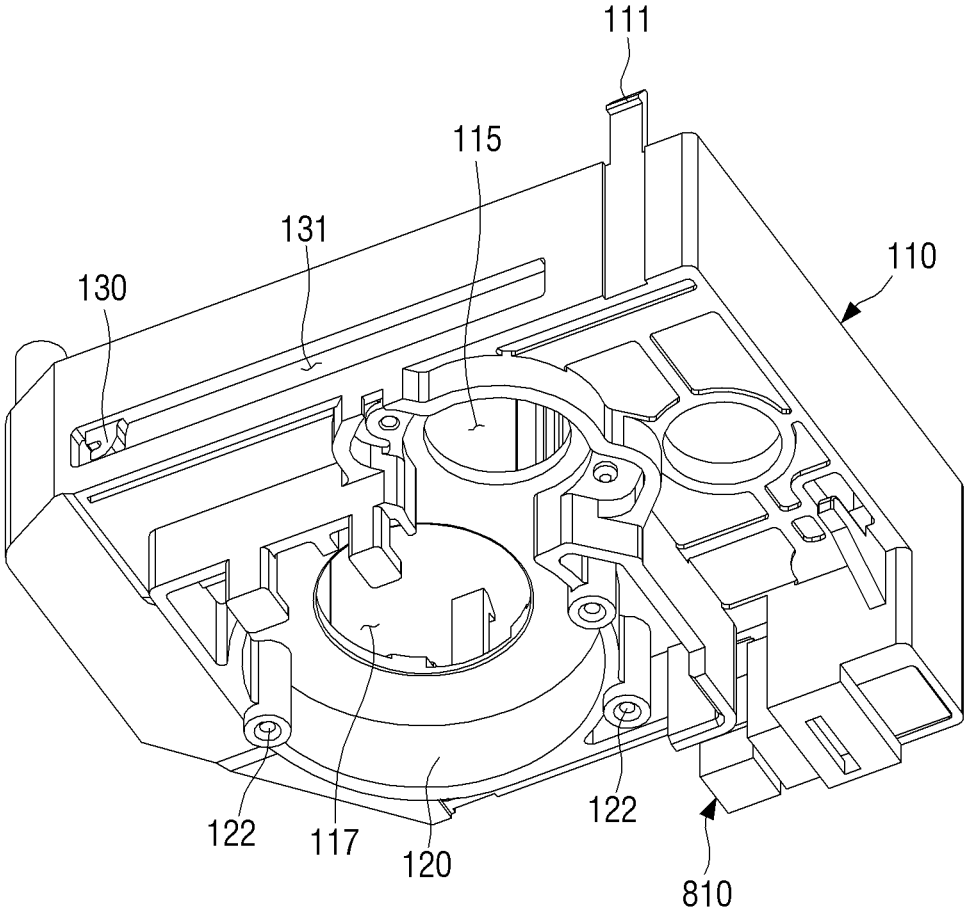
FIG. 7 is a bottom perspective view illustrating a lower case of the rotary knob assembly capable of up-and-down motion of FIG. 1, according to an exemplary embodiment.
Figure 8:
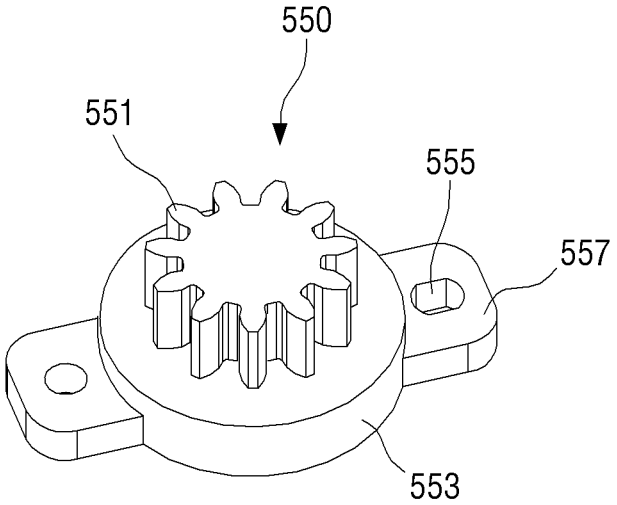
FIG. 8 is a perspective view illustrating an oil damper of the rotary knob assembly capable of up-and-down motion of FIG. 1, according to an exemplary embodiment.
Figure 9:
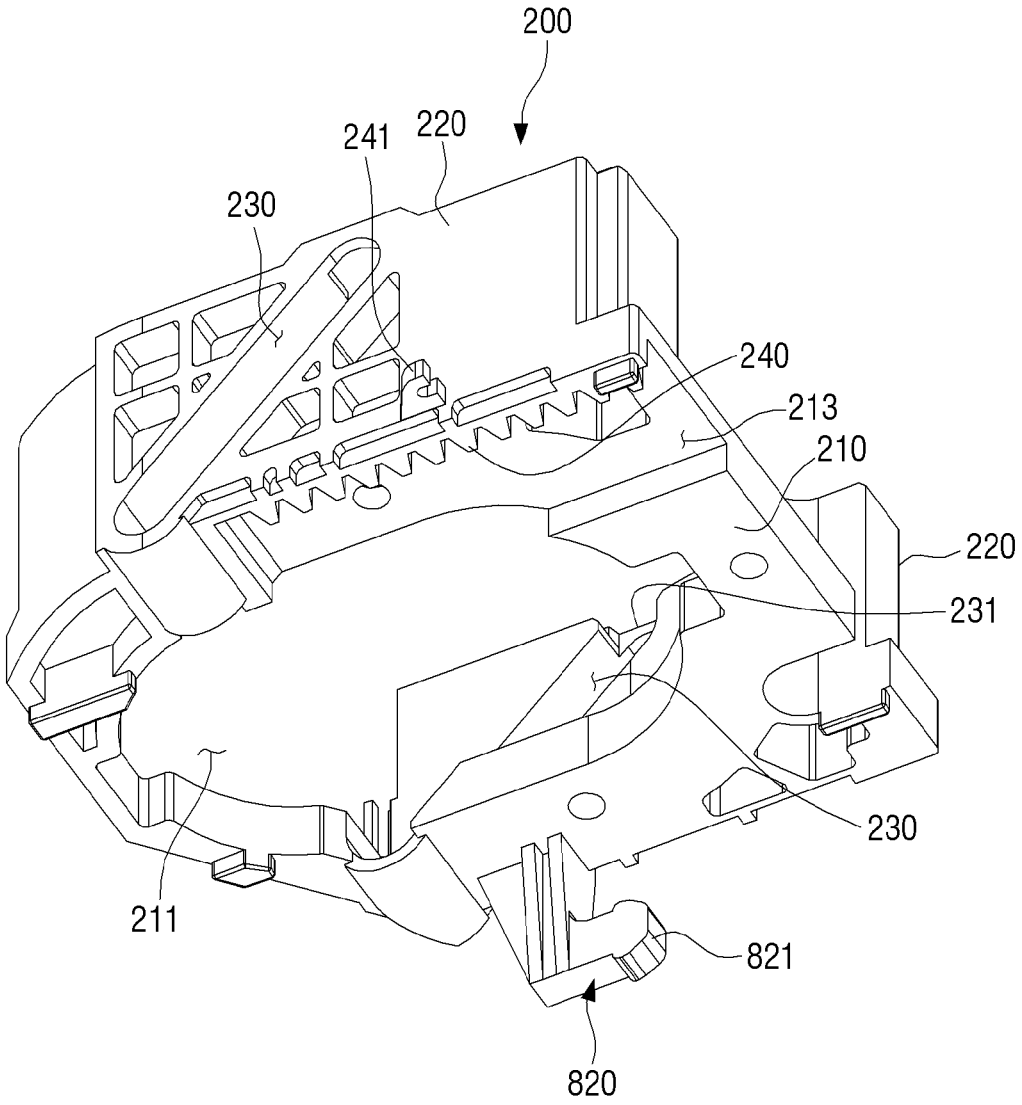
FIG. 9 is a bottom perspective view illustrating a slide cam of the rotary knob assembly capable of up-and-down motion of FIG. 1, according to an exemplary embodiment.
Figure 10:
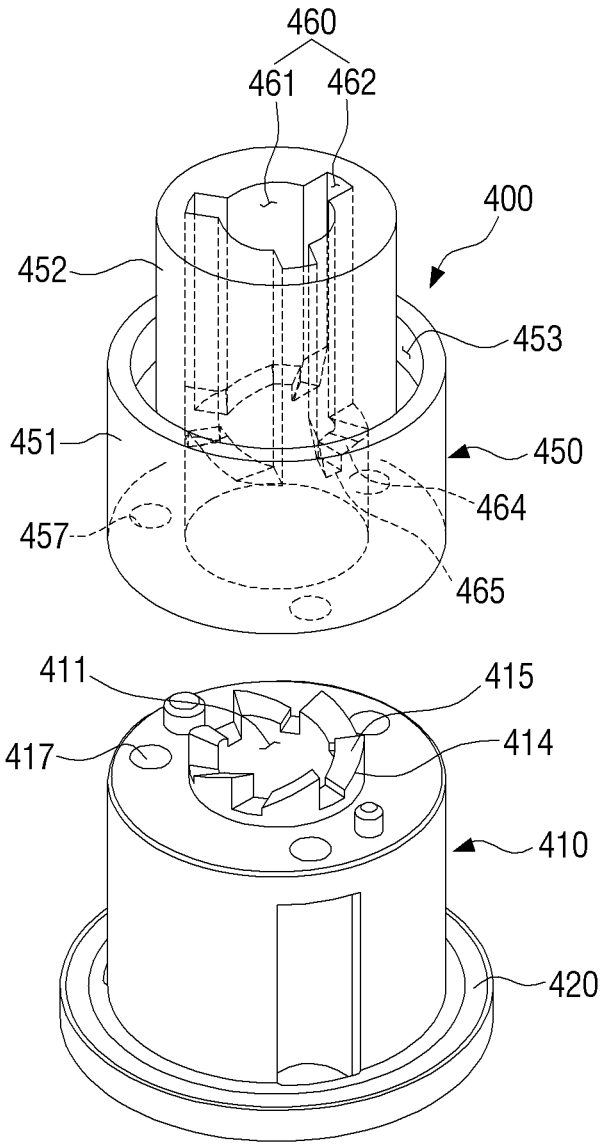
FIG. 10 is an exploded perspective view illustrating a rotary sleeve of the rotary knob assembly capable of up-and-down motion of FIG. 1, according to an exemplary embodiment.
Figure 11:
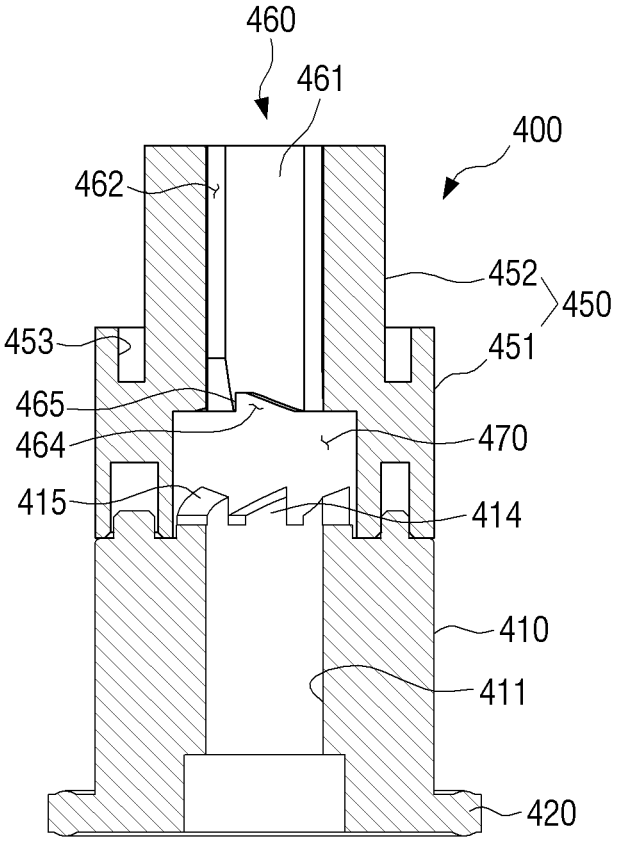
FIG. 11 is a cross-sectional view illustrating a state in which the rotary sleeve of FIG. 10 is assembled, according to an exemplary embodiment.
Figure 12:
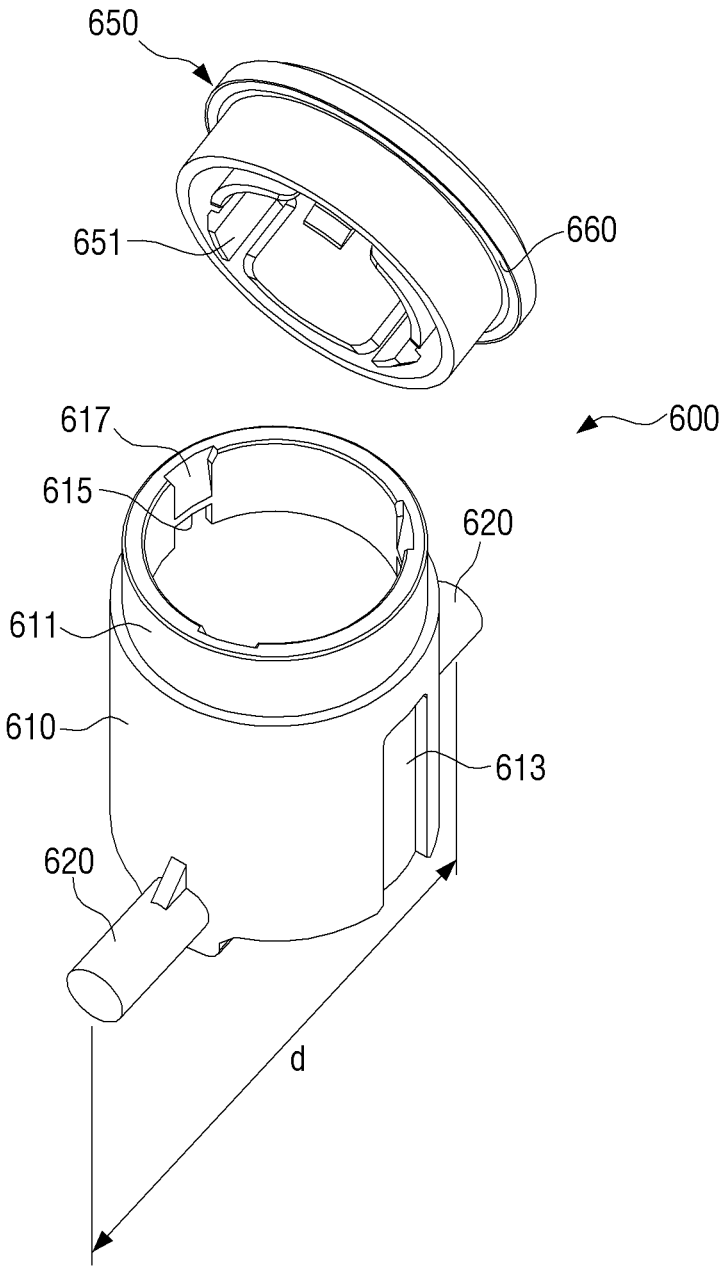
FIG. 12 is an exploded perspective view illustrating an up-and-down moving sleeve of the rotary knob assembly capable of up-and-down motion of FIG. 1, according to an exemplary embodiment.
Figure 13:
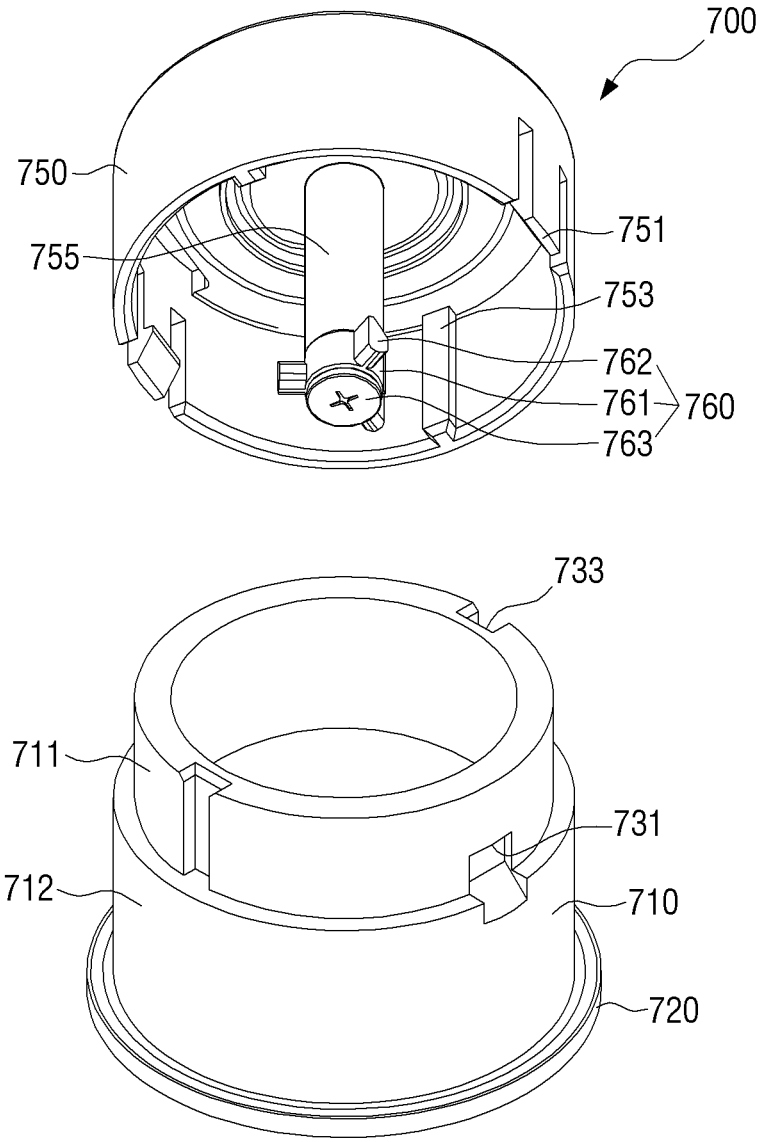
FIG. 13 is an exploded perspective view illustrating a rotary knob of the rotary knob assembly capable of up-and-down motion of FIG. 1, according to an exemplary embodiment.
Figure 14:
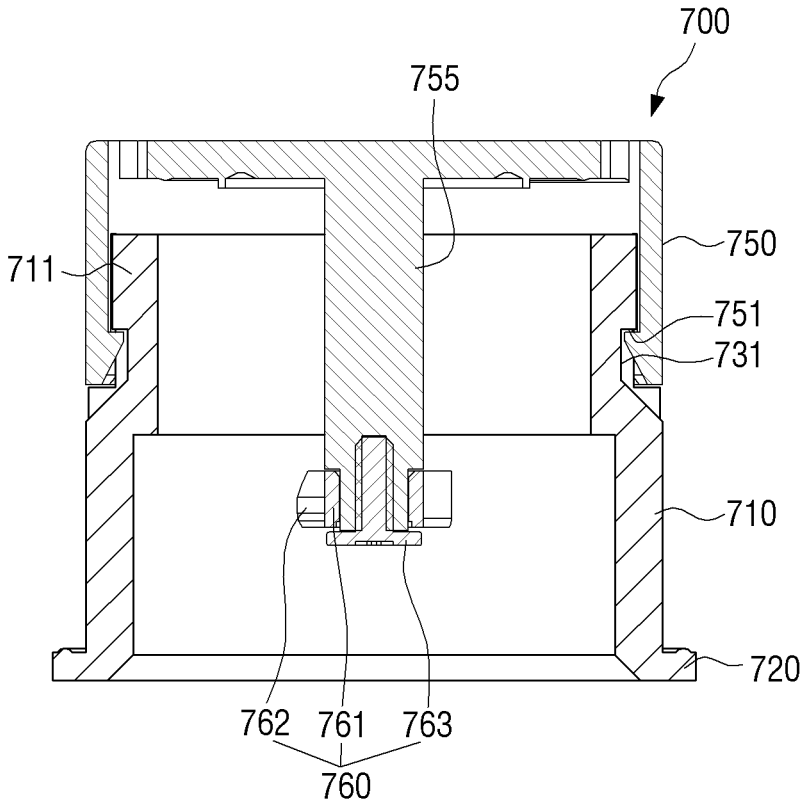
FIG. 14 is a cross-sectional view illustrating a state in which the rotary knob of FIG. 13 is assembled.

3, and FIG. 5 is a cross-sectional view illustrating the rotary knob assembly capable of up-and-down motion taken along line 5-5 of FIG. 3. FIG. 6 is a plan view illustrating the rotary knob assembly capable of up-and-down motion of FIG. 1 from which an upper case and a rotary knob are removed. FIG. 7 is a bottom perspective view illustrating a lower case of the rotary knob assembly capable of up-and-down motion of FIG. 1. FIG. 8 is a perspective view illustrating an oil damper of the rotary knob assembly capable of up-and-down motion of FIG. 1. FIG. 9 is a bottom perspective view illustrating a slide cam of the rotary knob assembly capable of up-and-down motion of FIG. 1. FIG. 10 is an exploded perspective view illustrating a rotary sleeve of the rotary knob assembly capable of up-and-down motion of FIG. 1, and FIG. 11 is a cross-sectional view illustrating a state in which the rotary sleeve of FIG. 10 is assembled. FIG. 12 is an exploded perspective view illustrating an up-and-down moving sleeve of the rotary knob assembly capable of up-and-down motion of FIG. 1, FIG. 13 is an exploded perspective view illustrating a rotary knob of the rotary knob assembly capable of up-and-down motion of FIG. 1, and FIG. 14 is a cross-sectional view illustrating a state in which the rotary knob of FIG. 13 is assembled.

Referring to FIGS. 1 through 6, a rotary knob assembly 1 capable of up-and-down motion according to an exemplary embodiment includes a case 100, a slide cam 200, an elastic member 300, a rotary sleeve 400, an up-and-down moving sleeve 600, and a rotary knob 700. For example, the up-and-down movement may include the rotary knob moving into and out of a case or housing. That is, the up-and-down movement may include movement in a horizontal direction, a vertical direction, or a combination thereof.

The case 100 creates a frame for the rotary knob assembly 1 which is capable of up-and-down motion according to an embodiment of the present disclosure, and accommodates the slide cam 200, the elastic member 300, the rotary sleeve 400, the up-and-down moving sleeve 600, and the rotary knob 700. As an example, the rotary knob assembly 1 may be disposed inside a device such as an audio player, for example, a receiver, a television, a DVD player, a game console, a Blu-ray player, a computer, and the like.

The case 100 may be formed of a shape that has a substantially rectangular cross-section, and which includes an upper case 150 and a knob hole 151 through which the rotary knob 700 projects, and a lower case 110 which is removably coupled to the upper case 150 and supports the slide cam 200 which is movable. The upper case 150 and the lower case 110 may be formed such that they are coupled by one-touch. For example, the upper case 150 and the lower case 110 may be coupled by a hook connection. In this example, the lower case 110 may be provided with two hooks 111 in a diagonal direction, and the upper case 150 may be provided with two catching portions 153 in which the two hooks 111 of the lower case 110 are caught. The hook connection of the upper case 150 and the lower case 110 is merely for purposes of example, and it should be appreciated that the upper case 150 and the lower case 110 may be coupled by various ways, such as a screw connection, and the like.

The upper case 150 may include a plurality of fixing brackets 155 which are used to secure the rotary knob assembly 1 to another device. For example, in FIGS. 1 and 2, three fixing brackets 155 are provided on an outer peripheral surface of the upper case 150. The fixing brackets 155 may include a fixing hole 156 in which a screw or a bolt may be inserted. Also, the knob hole 151 in which a rotary knob 700 is disposed, may protrude from and be formed in a bottom surface 157 (FIG. 3) of the upper case 150. The bottom surface 157 of the upper case 150 may limit the vertical movement of the rotary knob 700 that is inserted in the knob hole 151.

The lower case 110 supports the slide cam 200 so that the slide cam 200 may move linearly within the lower case 110. Also, the lower case 110 supports the rotary sleeve 400 so that the rotary sleeve 400 can perform a rotary movement. For example, the slide cam 200 may be disposed on the upper side of the bottom surface 113 of the lower case 110 so that the slide cam 200 can slide in approximately a straight line with respect to the bottom surface 113. The bottom surface 113 of the lower case 110 may include a damper hole 115 through which a pinion gear 551 of an oil damper 550 projects and a sleeve hole 117 through which the rotary sleeve 400 projects. The sleeve hole 117 may have an inner diameter that is smaller than an outer diameter of a rotary flange 420 provided in a lower end of the rotary sleeve 400 so that the rotary flange 420 can not pass through the sleeve hole 117. A pair of supporting brackets 119 that guide the movement of the up-and-down moving sleeve 600 and limits right and left shaking of the up-and-down moving sleeve 600 may be disposed around the sleeve hole 117. In the example of FIG. 7, the lower side of the bottom surface 113 of the lower case 110 includes a fixing ring receiving portion 120 in which a fixing ring 500 to support the rotary flange 420 of the rotary sleeve 400 to rotate, is disposed.

As illustrated in FIG. 2, the fixing ring 500 may be formed substantially in a ring shape. In this example, the inner diameter of the fixing ring 500 is formed to be greater than the outer diameter of the rotary flange 420 so that the rotary sleeve 400 can rotate. A rotary sleeve supporting portion 510 is provided inside the fixing ring 500. Accordingly, if the fixing ring 500 is disposed in the fixing ring receiving portion 120 of the lower case 110, as illustrated in the example of FIG. 3, a space in which the rotary flange 420 of the rotary sleeve 400 can rotate may be formed between the bottom surface 113 of the lower case 110 and the rotary sleeve supporting portion 510 of the fixing ring 500. Accordingly, because the rotary sleeve 400 is supported by the fixing ring 500 disposed in the lower case 110, the rotary sleeve 400 may rotate freely with respect to the lower case 110 without being separated from the lower case 110.

A volume circuit board 920 may be disposed at a top end of the fixing ring receiving portion 120 of the lower case 110. For example, a plurality of female screw portions 122 may be provided in an outer peripheral surface of the fixing ring receiving portion 120. In this exemplary embodiment, three female screw portions 122 are provided. Accordingly, the volume circuit board 920 may be fixed to the female screw portions 122 of the lower case 110 by a plurality of screws or bolts. If the volume circuit board 920 is fixed to the lower case 110, the fixing ring 500 may not come out from the fixing ring receiving portion 120 of the lower case 110.

The volume circuit board 920 may be a printed circuit board in which a variable volume 900 is disposed. The variable volume 900 may be fixed to a surface of the volume circuit board 920, and a wire or a flexible cable (not illustrated) may be connected to the other surface of the volume circuit board 920. The volume circuit board 920 may serve to fix the fixing ring 500 to the fixing ring receiving portion 120 of the lower case 110. Here, a rotation shaft 910 is disposed in a top surface of the variable volume 900. Accordingly, if the rotation shaft 910 is rotated, the volume is varied. In detail, if the rotation shaft 910 is rotated in one direction, the volume is increased, and, if the rotation shaft 910 is rotated in the opposite direction, the volume is decreased. The variable volume 900 may use related variable volumes. Accordingly, descriptions for the structure and operation of the variable volume 900 are omitted. The rotation shaft 910 of the variable volume 900 is connected to the bottom end of the rotary sleeve 400 so that the rotation shaft 910 is rotated integrally with the rotary sleeve 400.

According to various exemplary embodiments, the fixing ring 500 is fixed to the lower case 110 by the volume circuit board 920. However, this is merely for purposes of example. The rotary knob assembly 1 capable of up-and-down motion may be used not only to control the volume. For example, the rotary knob assembly 1 capable of up-and-down motion according to an exemplary embodiment may be configured so that an output variable element output of which is changed by rotation of a rotation shaft instead of the variable volume 900 is disposed in the printed circuit board 920 and the rotation shaft of the output variable element is rotated by the rotary sleeve 400.

In this example, an oil damper 550 is disposed at a side of the fixing ring 500 in the lower side of the bottom surface 113 of the lower case 110. The oil damper 550 may control a moving speed of the slide cam 200. For example, as illustrated in FIG. 8, the oil damper 550 includes a pinion gear 551, and an oil tank 553 where the pinion gear 551 is rotatably disposed. The oil tank 553 includes oil therein. Also, a rotating member (not illustrated) that rotates coaxially with the pinion gear 551 may be disposed inside the oil tank 553. In this example, when the pinion gear 551 rotates, the rotating member is rotated integrally with the pinion gear 551. Accordingly, the rotational speed of the pinion gear 551 may be slowed due to a viscosity resistance of the oil applied to the rotating member while it is submerged in the oil of the oil tank 553. Accordingly, when the pinion gear 551 is rotated by a certain force that is applied to the pinion gear 551, the pinion gear 551 may be rotated slower than a pinion gear which is not connected to the oil tank 553 due to the viscosity resistance of the oil. Also, the oil damper 550 is disposed such that the pinion gear 551 projects through the damper hole 115 that is formed in the bottom surface 113 of the lower case 110. The oil tank 553 may be provided with at least one fixing bracket 557 in which a through hole 555 is formed. The oil damper 550 may be fixed to the bottom surface 113 of the lower case 110 by the fixing brackets 557 and screws.

The slide cam 200 is disposed such that it can slidably move in a straight line with respect to the bottom surface 113 of the lower case 110, and is formed in a substantially flattened U shape. For example, referring to FIGS. 2 and 9, the slide cam 200 includes a base plate 210 and two side walls 220 extending upwardly from the base plate 210. Here, the two side walls 220 are formed facing each other in parallel, and each side wall 220 is provided with a cam groove 230 that is inclined in an upward direction. A top end of the cam groove 230 is open such that a pair of up-and-down cams 620 of the up-and-down moving sleeve 600 can be inserted into the cam grooves 230. Because the side walls 220 are formed to have a predetermined thickness to support the pair of up-and-down cams 620 that are inserted in the cam grooves 230, the side walls 220 can hide a downward movement of the pair of up-and-down cams 620 of the up-and-down moving sleeve 600 into a horizontal movement of the slide cam 200, whereas the side walls 220 can hide the horizontal movement of the slide cam 200 into an upward movement of the up-and-down moving sleeve 600.

A rotary sleeve 400 disposed in the lower case 110 passes through a rotary sleeve through hole 211, and is formed in the base plate 210. The rotary sleeve through hole 211 may have an elongated hole shape so that, when the slide cam 200 is moved linearly, the slide cam 200 does not interfere with the rotary sleeve 400. A moving groove 213 in which the pinion gear 551 of the oil damper 550 is able to move is formed in parallel to the rotary sleeve through hole 211 in one side of the rotary sleeve through hole 211 in the bottom surface of the base plate 210. A rack gear 240 is formed on the side surface of the moving groove 213 to engage with the pinion gear 551 of the oil damper 550. Accordingly, if the slide cam 200 is moved, the pinion gear 551 of the oil damper 550 that is engaged with the rack gear 240 is rotated.

An elastic member 300 which applies an elastic force that can overcome the viscous resistance of the oil damper 550 to the slide cam 200, is disposed between the slide cam 200 and the lower case 110. For example, the elastic member 300 may be disposed between the side surface of the slide cam 200 on which the rack gear 240 is formed and the lower case 110 facing the side surface thereof. Also, one end of the elastic member 300 is fixed to a first protrusion 241 that is formed on the side wall of the slide cam 200, and the other end of the elastic member 300 is fixed to a second protrusion 130 formed on the side wall of the lower case 110. Here, the side wall of the lower case 110 may include a slot 131 to accommodate the elastic member 300 in the operating direction of the slide cam 200 so that the lower case 110 does not interfere with the operation of the elastic member 300. Also, the elastic member 300 may be a coil spring.

A secondary fixing hook 820 (FIG. 9) is disposed in the lower side of the base plate 210 of the slide cam 200 in a moving direction of the slide cam 200. The bottom surface 113 of the lower case 110 includes a hook through hole 133 through which the secondary fixing hook 820 of the slide cam 200 can pass and which prevents the secondary fixing hook 820 from interfering with the lower case 110 during linear movement of the slide cam 200. A push-push latch 810 that may be coupled with the secondary fixing hook 820 is disposed adjacent to one end of the hook through hole 133 in the lower side of the bottom surface 113 of the lower case 110. If the secondary fixing hook 820 presses on the push-push latch 810, the push-push latch 810 may hold a head portion 821 of the secondary fixing hook 820, and if the push-push latch 810 is pressed again by the secondary fixing hook 820, the push-push latch 810 may release the head portion 821 of the secondary fixing hook 820. Accordingly, the slide cam 200 may be coupled to the lower case 110 or may release the engagement with the lower case 110 with a single touch by the linear movement of the slide cam 200. As a non limiting example, a conventional push-push latch may be used as the push-push latch 810.

In the above examples, the secondary fixing hook 820 is disposed in the slide cam 200, and the push-push latch 810 is disposed in the lower case 110. However, the exemplary embodiments are not limited to the installation of the secondary fixing hook 820 and the push-push latch 810. Although not illustrated, for example, the secondary fixing hook 820 may be disposed in the lower case 110, and the push-push latch 810 may be disposed in the slide cam 200.

The rotary sleeve 400 supports the up-and-down moving sleeve 600 so that it can move up and down. The rotary sleeve 400 is formed such that it can rotate a rotating object, for example, the rotation shaft 910 of the variable volume 900. Referring to FIGS. 10 and 11, the rotary sleeve 400 may include a lower rotary sleeve 410 and an upper rotary sleeve 450.

The lower rotary sleeve 410 may be formed of a hollow cylindrical shape, and may include a rotary flange 420 at a bottom end of the lower rotary sleeve 410. The rotary flange 420 may include a size that does not pass through the sleeve hole 117 of the lower case 110, and is supported by the fixing ring 500. Because the rotary flange 420 of the lower rotary sleeve 410 rotates in a space between the fixing ring receiving portion 120 and the fixing ring 500 of the lower case 110, the lower rotary sleeve 410 may not separate from the lower case 110, and may rotate with respect to the lower case 110. A hollow 411 of the lower rotary sleeve 410 is formed in a fixing groove to fix the rotation shaft 910 of the variable volume 900. In the example of FIGS. 2 and 5, the rotation shaft 910 of the variable volume 900 is machined as a D-cut, in which the hollow 411 of the lower rotary sleeve 410 is formed in a fixing groove which can receive the D-cut portion of the rotation shaft 910. Accordingly, if the rotation shaft 910 of the variable volume 900 is coupled to the fixing groove 411 of the lower rotary sleeve 410, and the lower rotary sleeve 410 is rotated, the rotation shaft 910 may be rotated along with the lower rotary sleeve 410.

A plurality of inclined teeth 414 are formed around the hollow 411 of the top end of the lower rotary sleeve 410. Referring to the example of FIG. 10, six inclined teeth 414 are formed, and the inclined teeth 414 are spaced apart by a predetermined interval. A plurality of fixing holes 417 are formed concentrically with the hollow 411 along the outside of the plurality of inclined teeth 414. The plurality of fixing holes 417 are used to combine the lower rotary sleeve 410 and the upper rotary sleeve 450 so that they are not separated from each other.

The upper rotary sleeve 450 is formed of a hollow cylindrical shape, and is coupled to the lower rotary sleeve 410. For example, the upper rotary sleeve 450 may be formed in a two-stage structure having different outer diameters. In this example, a lower portion 451 of the upper rotary sleeve 450 is coupled to the lower rotary sleeve 410 and is formed to have the same outer diameter as the outer diameter of the lower rotary sleeve 410 or an outer diameter similar to the outer diameter of the lower rotary sleeve 410. An upper portion 452 of the upper rotary sleeve 450 is formed to have an outer diameter that is smaller than that of the lower portion 451. A ring-shaped spring groove 453 may be formed between the upper portion 452 and the lower portion 451 of the upper rotary sleeve 450 so that a coil spring 350 may elastically support the rotary knob 700 and be disposed in the spring groove 453.

The upper portion 452 of the upper rotary sleeve 450 includes a connecting hole 460 configured to receive a connecting member 760 of the rotary knob 700. In this example, the connecting hole 460 includes a central hole 461 and three slots 462 extending in a radial direction from the central hole 461. The central hole 461 and three slots 462 are formed to penetrate the upper portion 452 of the upper rotary sleeve 450. An example of the connecting member 760 of the rotary knob 700 is further described herein and may be inserted into the central hole 461 and three slots 462 of the upper rotary sleeve 450. A bottom surface of the upper portion 452 of the upper rotary sleeve 450 includes jaws 465 and receiving grooves 464 that are inclined in an upward direction between the slots 462. A side surface of the jaws 465 connected to the slot 462 is inclined upwardly toward the slot 462. Ribs 762 of the connecting member 760 of the rotary knob 700 are caught by the receiving grooves 464 of the bottom surface of the upper portion 452. In this example, the connecting member 760 has three ribs 762, and the connecting hole 460 in which the connecting member 760 is inserted has three slots 462. However, this is merely for purposes of example, and it should be appreciated that the connecting member 760 may be formed to have, one, two, three, four or more ribs 762, and the connecting hole 460 may be formed to have a number of slots 462 corresponding to the number of ribs 762.

In this example, an inclined teeth receiving hole 470 (shown in FIG. 11) that has a diameter larger than a diameter of the central hole 461 of the upper portion 452 is formed in the lower portion 451 of the upper rotary sleeve 450. The inclined teeth receiving hole 470 may receive the plurality of inclined teeth 414 of the lower rotary sleeve 410, and is formed so that the connecting member 760 of the rotary knob 700 may be inserted into and rotate within the inclined teeth receiving hole 470. Accordingly, the inclined teeth receiving hole 470 of the lower portion 451 of the upper rotary sleeve 450 may include a receiving space in which the connecting member 760 of the rotary knob 700 freely rotates.

Also, a plurality of screw holes 457 (shown in FIG. 10) may be formed around the inclined teeth receiving hole 470 in a bottom surface of the lower portion 451 of the upper rotary sleeve 450. If the upper rotary sleeve 450 is coupled to the top end of the lower rotary sleeve 410 and screws are fastened to the plurality of screw holes 457 through the fixing holes 417 of the lower rotary sleeve 410, the upper rotary sleeve 450 and the lower rotary sleeve 410 may be coupled together and rotate integrally.

The up-and-down moving sleeve 600 is connected to the rotary knob 700, and is moved up and down according to a vertical movement of the rotary knob 700 which allows the slide cam 200 to move linearly in a horizontal direction. For example, the up-and-down moving sleeve 600 may convert a linear movement in a vertical direction into a linear movement in the horizontal direction with the slide cam 200. The up-and-down moving sleeve 600 may include a hollow cylindrical shape, and may include a pair of up-and-down cams 620 in a low end portion of the side surface of the up-and-down moving sleeve 600. Each of the up-and-down cams 620 may include a bar shape having a circular cross-section. A distance 'd' between opposing ends of the pair of up-and-down cams 620 is formed so that the ends can be inserted into the top ends of the cam grooves 230 formed in the opposite side walls 220 of the slide cam 200 and to press the opposite side walls 220 of the slide cam 200 forming the cam groove 230. Accordingly, the pair of up-and-down cams 620 of the up-and-down moving sleeve 600 may be inserted into the cam groove 230 through the top end 231 of the slide cam 200, and press or otherwise apply pressure to the slide cam 200. Because the upper side of the slide cam 200 is covered by the upper case 150, even in an example in which the up-and-down moving sleeve 600 is being moved up and down, the up-and-down moving sleeve 600 does not come out of the cam groove 230.

As illustrated in FIG. 12, the up-and-down moving sleeve 600 may include a sleeve body 610 that includes a pair of up-and-down cams 620 and a sleeve cap 650 that is coupled to the sleeve body 610. The pair of up-and-down cams 620 are included in the low end portion of the side surface of the sleeve body 610. A top end of the sleeve body 610 includes a connection step 611 that may be inserted in the sleeve cap 650. The sleeve body 610 includes a hollow cylindrical shape, and has an inner diameter in which the rotary sleeve 400 can be inserted. Accordingly, if the up-and-down moving sleeve 600 descends, the rotary sleeve 400 may be inserted into the up-and-down moving sleeve 600. In this example, a pair of supporting grooves 613 are provided in a position that corresponds to the pair of supporting brackets 119 included in the bottom surface 113 of the lower case 110 in the side surface of the sleeve body 610. Accordingly, when the up-and-down moving sleeve 600 is moved up and down by the rotary knob 700, the up-and-down moving sleeve 600 can be moved, stably, for example, by a pair of supporting brackets 119 that are inserted in the pair of supporting grooves 613.

As illustrated in FIG. 3, the sleeve cap 650 is connected to the rotary knob 700 to allow the rotary knob 700 to rotate. The sleeve cap 650 is formed in a hollow cylindrical shape, and has a sleeve flange 660 in the top end of the sleeve cap 650. A plurality of coupling hooks 651 are formed in the inner surface of the sleeve cap 650. In this example, three coupling hooks 651 are provided. The plurality of coupling hooks 651 are formed such that they are hooked to the plurality of engaging jaws 615 formed in the inner surface of the connection step 611 of the sleeve body 610. Also, a plurality of guide grooves 617 to guide the insertion of the plurality of coupling hooks 651 to the plurality of hooking jaws 615 are formed obliquely in the connection step 611 of the sleeve body 610.

Accordingly, if the sleeve cap 650 is inserted in the connection step 611 of the sleeve body 610, each of the plurality of coupling hooks 651 of the sleeve cap 650 may be moved downwardly along the guide grooves 617 of the sleeve body 610, and then may be caught by the hooking jaws 615. Thus, the sleeve cap 650 may be coupled to the sleeve body 610 so that the sleeve cap 650 is not separated from the sleeve body 610. In this example, the number of the coupling hooks 651 is not limited to three. For example, the number of coupling hooks 651 may be one, two, three, four, or more.

The rotary knob 700 is rotatably coupled to the up-and-down moving sleeve 600, and is configured to be moved up and down with respect to the upper case 150 by a force, for example, that is applied from the outside. For example, as illustrated in FIGS. 13 and 14, the rotary knob 700 may include an upper rotary knob 750 and a lower rotary knob 710.

The upper rotary knob 750 may be formed of a hollow cylindrical shape with a bottom. A connecting member 760 can be inserted in the connecting hole 460 of the rotary sleeve 400 and may be formed in the center of the bottom of the upper rotary knob 750. The connecting member 760 may be connected to a central axis 755 extending from the bottom of the upper rotary knob 750 by a screw. For example, the connecting member 760 may be formed of a cylindrical body 761 and a plurality of ribs 762 extending radially from the surface of the body 761. A through hole (not illustrated) for screwing to the central axis 755 of the upper rotary knob 750 may be formed in the center of the body 761. The plurality of ribs 762 may be formed in a wedge shape so that the ribs 762 move smoothly along the slots 462 of the connecting hole 460 of the rotary sleeve 400. Also, the ribs 762 may be smoothly inserted into the slots 462 from the receiving grooves 464 of the bottom surface of the rotary sleeve 400.

As a non-limiting example, the connecting member 760 may include three ribs 762 in the same manner as the number of the slots 462 of the connecting hole 460 of the rotary sleeve 400. Accordingly, if the connecting member 760 of the rotary knob 700 is inserted into the connecting hole 460 of the rotary sleeve 400, the rotary knob 700 may be moved up and down with respect to the rotary sleeve 400. Also, if the connecting member 760 of the rotary knob 700 is located within the connecting hole 460 of the rotary sleeve 400, and the rotary knob 700 is rotated, the rotary sleeve 400 may be rotated together with the rotary knob 700. If the connecting member 760 of the rotary knob 700 passes through the connecting hole 460 and is located in the inclined teeth receiving hole 470, the rotation of the rotary knob 700 may not be transmitted to the rotary sleeve 400. In this example, the connecting member 760 is formed separately from the upper rotary knob 750. However, this is merely for purposes of example, and it should be appreciated that the connecting member 760 may be formed integrally with the upper rotary knob 750.

Referring again to FIG. 13, the side surface of the upper rotary knob 750 includes a plurality of fixing hooks 751 and a plurality of guide protrusions 753 that allow the upper rotary knob 750 to be detachably coupled to the lower rotary knob 710.

The lower rotary knob 710 is formed of a hollow cylindrical shape, and includes an upper stem 711 and a lower stem 712. An outer diameter of the upper stem 711 is smaller than an outer diameter of the lower stem 712. The upper rotary knob 750 may be connected to the upper stem 711 of the lower rotary knob 710. The upper stem 711 of the lower rotary knob 710 includes a plurality of fixing grooves 731 by which the plurality of fixing hooks 751 of the upper rotary knob 750 are caught and a plurality of guide grooves 733 into which the plurality of guide protrusions 753 are inserted. Accordingly, if the upper rotary knob 750 is inserted into the upper stem 711 of the lower rotary knob 710, each of the plurality of fixing hooks 751 may be caught by the fixing groove 731 so that the upper rotary knob 750 is connected to the lower rotary knob 710. A flange 720 is also provided in the bottom end of the lower rotary knob 710. The flange 720 of the lower rotary knob 710 is formed larger than the diameter of the knob hole 151 of the upper case 150. Accordingly, when the rotary knob 700 is moved upwardly with respect to the upper case 150, the flange 720 is caught by the bottom surface 157 of the upper case 150. Therefore, the flange 720 may function as a stopper to limit a rising distance of the rotary knob 700.

The rotary knob 700 may be rotatably coupled to the up-and-down moving sleeve 600 so that the rotary knob 700 can move up and down with the up-and-down moving sleeve 600 while rotating with respect to the up-and-down moving sleeve 600. For example, referring to FIG. 3, when the sleeve cap 650 of the up-and-down moving sleeve 600 is inserted in the top end of the lower rotary knob 710, the upper rotary knob 750 is coupled to the lower rotary knob 710. In this example, if the sleeve body 610 is coupled to the sleeve cap 650, the up-and-down moving sleeve 600 can rotate with respect to the rotary knob 700.

Also, because the sleeve flange 660 of the up-and-down moving sleeve 600 is located in a space between the lower rotary knob 710 and the upper rotary knob 750 of the rotary knob 700, the rotary knob 700 can be moved up and down along with the up-and-down moving sleeve 600 by vertical movement of the up-and-down moving sleeve 600. In this example, the rotary knob 700 may be elastically supported by the coil spring 350 disposed in the spring groove 453 of the rotary sleeve 400 that passes through the inside of the up-and-down moving sleeve 600.

Hereinafter, examples of the rotary knob assembly 1 capable of up-and-down motion are described with reference to FIGS. 3 to 6, and FIGS. 15 to 21.

Figure 15:
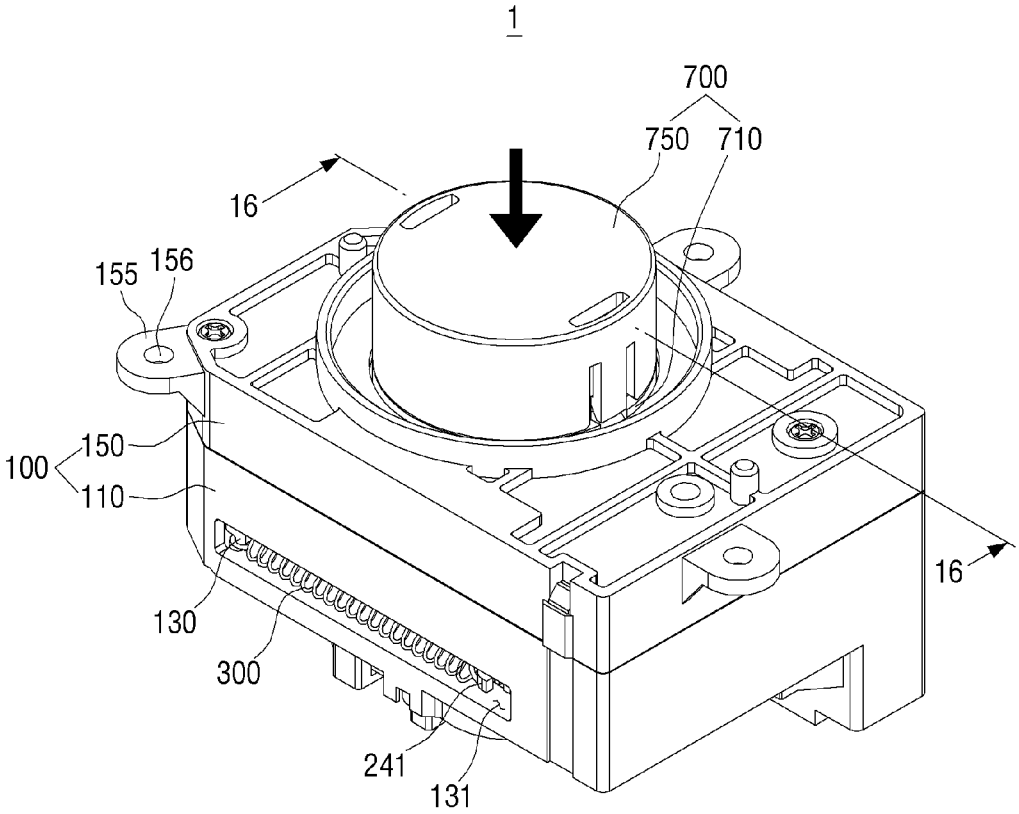
FIG. 15 is a perspective view illustrating a state in which a rotary knob of the rotary knob assembly capable of up-and-down motion of FIG. 1 is pressed, according to an exemplary embodiment.
Figure 16:
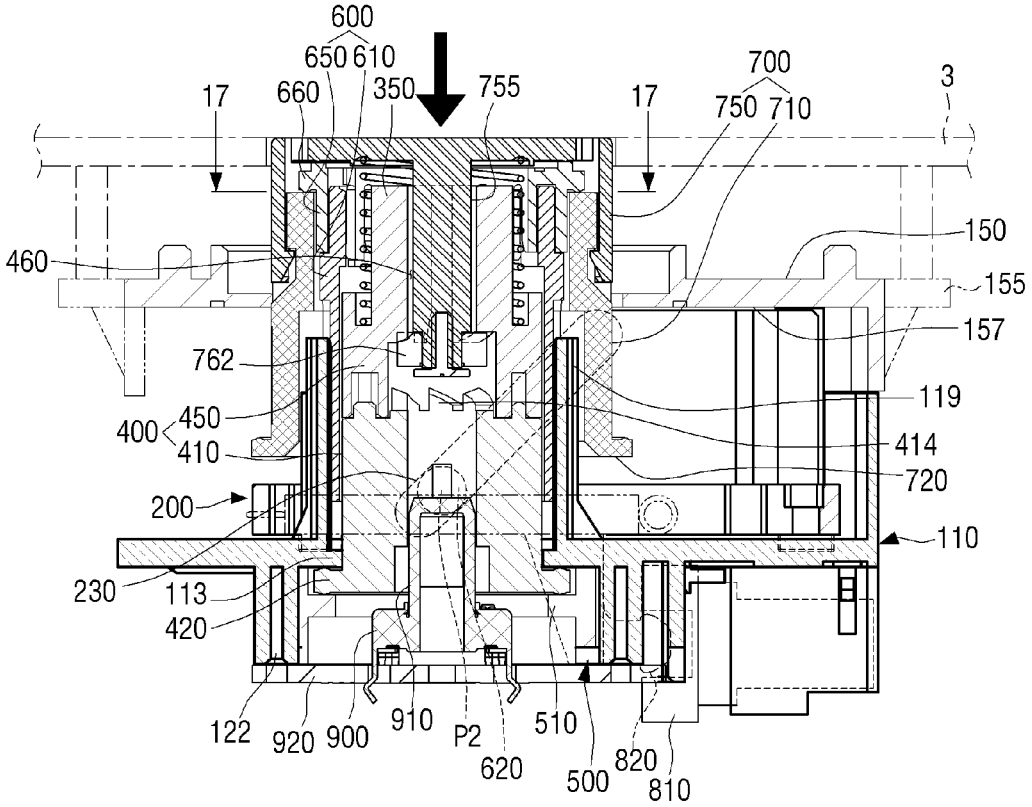
FIG. 16 is a cross-sectional view illustrating the rotary knob assembly capable of up-and-down motion taken along line 16-16 of FIG. 15, according to an exemplary embodiment.
Figure 17:
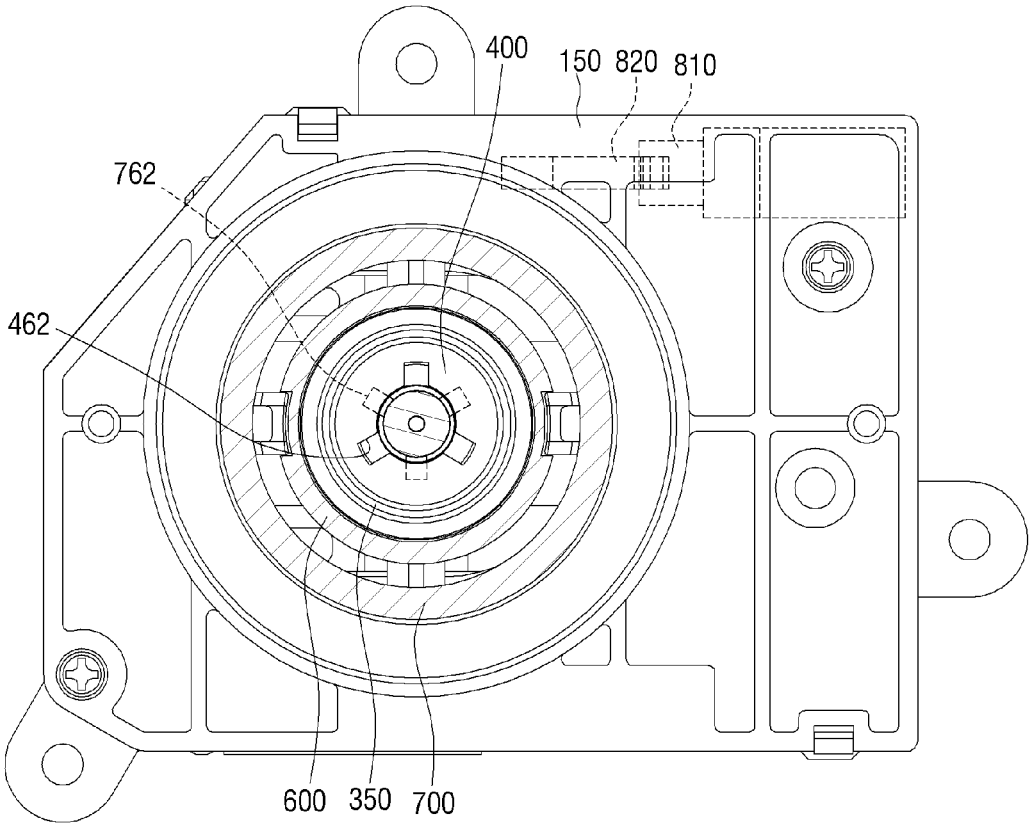
FIG. 17 is a cross-sectional view illustrating the rotary knob assembly capable of up-and-down motion taken along line 17-17 of FIG. 16, according to an exemplary embodiment.
Figure 18:
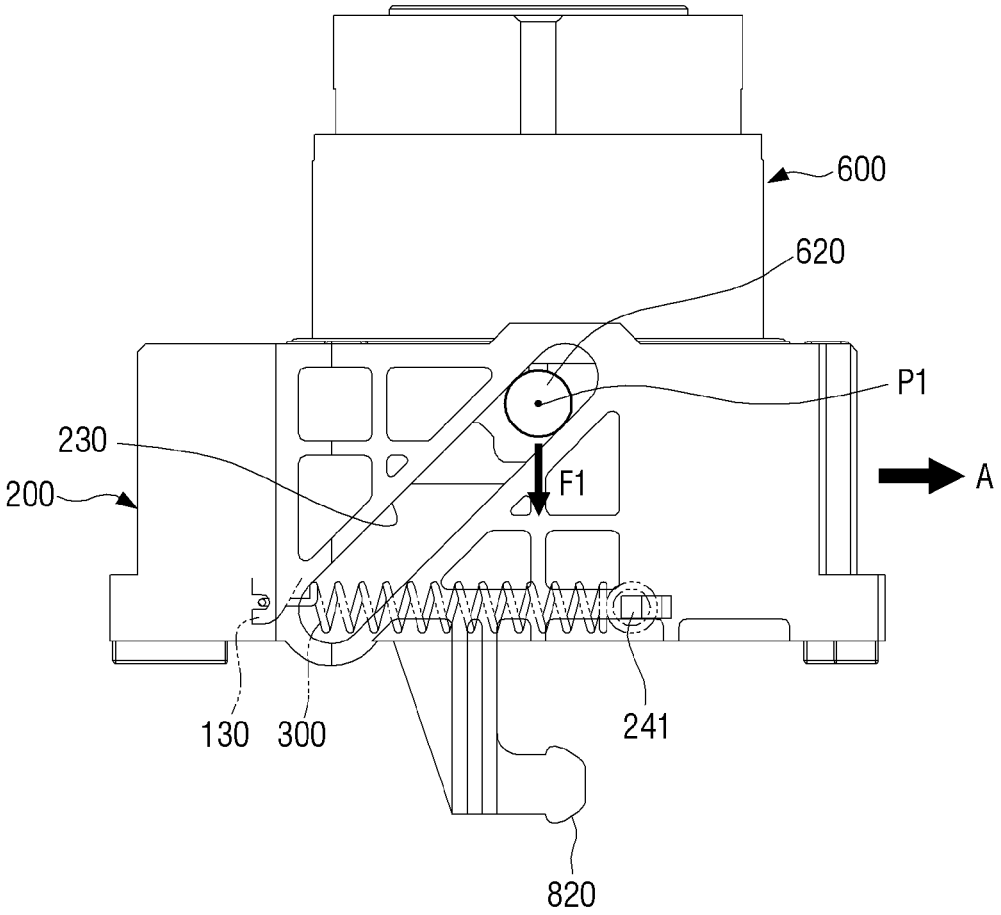
FIG. 18 is a view illustrating a relationship between an up-and-down cam of an up-and-down moving sleeve and a cam groove of a slide cam of a rotary knob of a protruding rotary knob assembly capable of up-and-down motion according to an exemplary embodiment.
Figure 19:
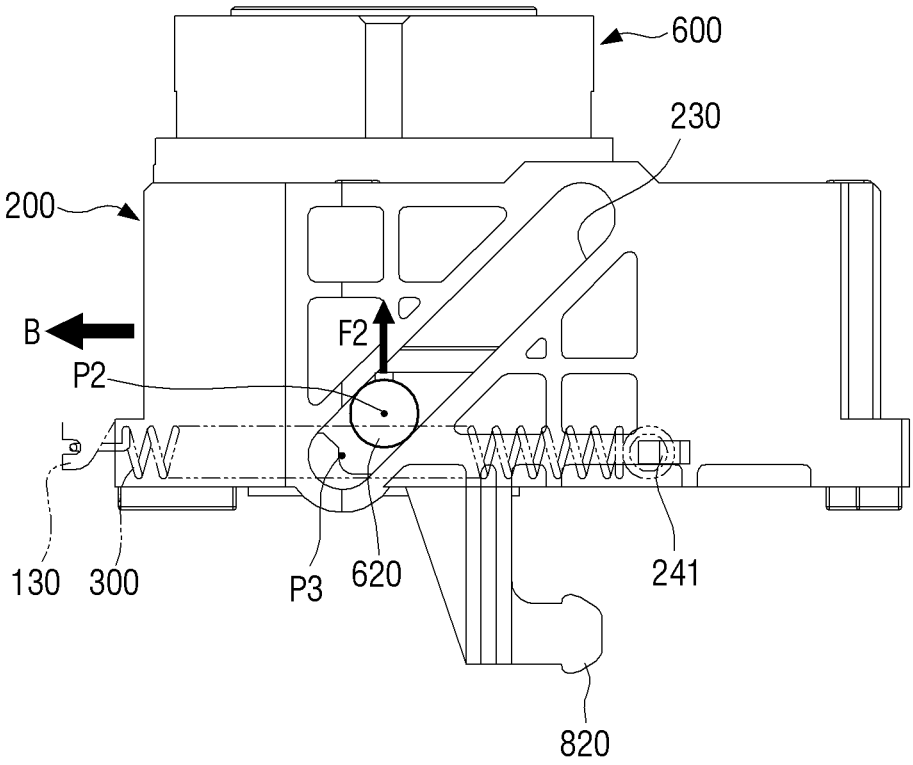
FIG. 19 is a view illustrating a relationship between an up-and-down cam of an up-and-down moving sleeve and a cam groove of a slide cam when a rotary knob of a rotary knob assembly capable of up-and-down motion is pressed according to an exemplary embodiment.

FIG. 15 is a diagram illustrating a state in which a rotary knob of the rotary knob assembly capable of up-and-down motion of FIG. 1 is pressed according to an exemplary embodiment. FIG. 16 is a cross-sectional view illustrating the rotary knob assembly capable of up-and-down motion taken along line 16-16 of FIG. 15, and FIG. 17 is a cross-sectional view illustrating the rotary knob assembly capable of up-and-down motion taken along line 17-17 of FIG. 16. FIG. 18 is a view illustrating a relationship between an up-and-down cam of an up-and-down moving sleeve and a cam groove of a slide cam in which a rotary knob of a rotary knob assembly capable of up-and-down motion according to an exemplary embodiment protrudes. FIG. 19 is a view illustrating a relationship between an up-and-down cam of an up-and-down moving sleeve and a cam groove of a slide cam in which a rotary knob of a rotary knob assembly capable of up-and-down motion according to an exemplary embodiment is pressed.

Figure 20:
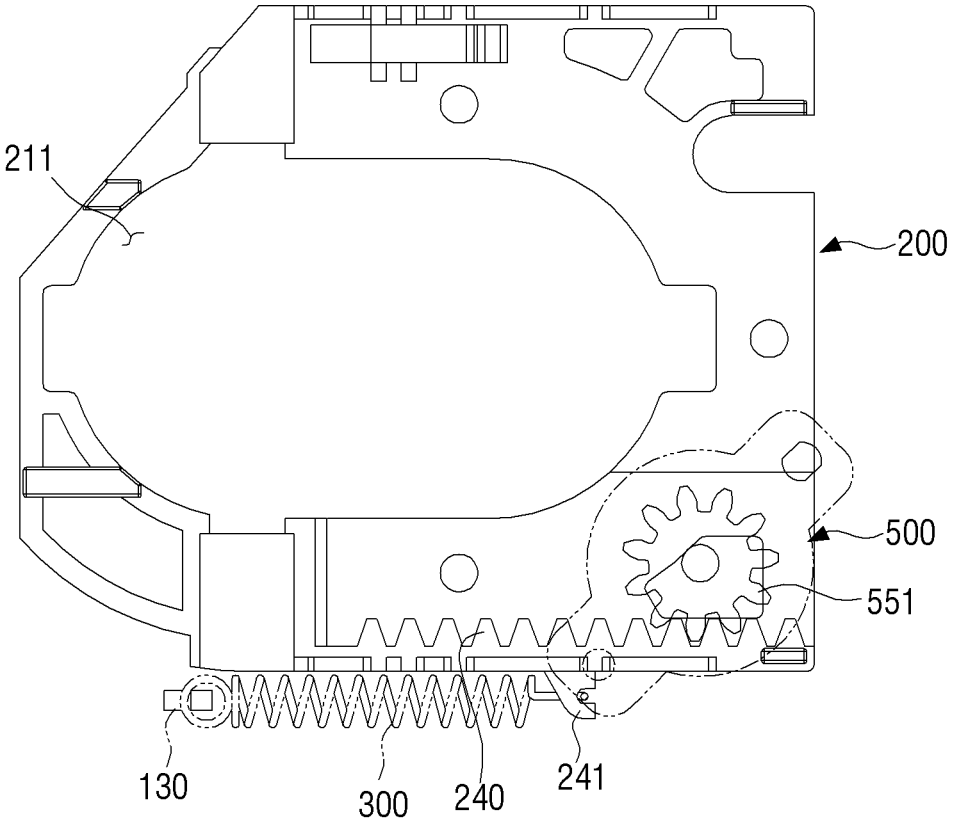
FIG. 20 is a view illustrating a relationship between an oil damper and a rack gear of a slide cam when a rotary knob of a rotary knob assembly capable of up-and-down motion protrudes according to an exemplary embodiment.
Figure 21:
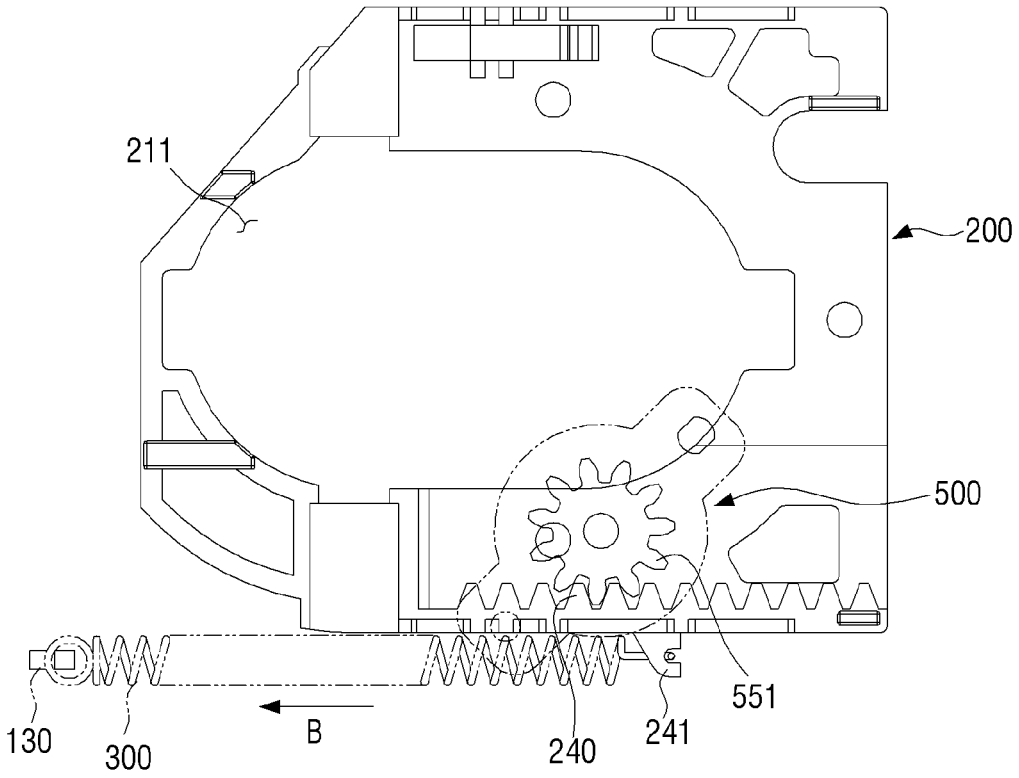
FIG. 21 is a view illustrating a relationship between an oil damper and a rack gear of a slide cam when a rotary knob of a rotary knob assembly capable of up-and-down motion is pressed according to an exemplary embodiment.

In the examples of FIGS. 18 and 19, other components are not illustrated for convenience of description. FIG. 20 is a view illustrating a relationship between an oil damper and a rack gear of a slide cam in which a rotary knob of a rotary knob assembly capable of up-and-down motion protrudes, and FIG. 21 is a view illustrating a relationship between an oil damper and a rack gear of a slide cam in which a rotary knob of a rotary knob assembly capable of up-and-down motion is pressed. In FIGS. 20 and 21, for convenience of description, a slide cam, an oil damper, and an elastic member are only illustrated, however, these examples may include other components that are not illustrated.

In the rotary knob assembly 1 capable of up-and-down motion as illustrated in FIG. 3, when the rotary knob 700 projects from a panel 3 of the a device, a user can rotate the rotary knob 700 to adjust the volume.

In a state in which the rotary knob 700 projects as illustrated in FIGS. 1 and 3, if the user presses the rotary knob 700, the rotary knob 700 may be inserted into the inside of the panel 3 so that the top surface of the rotary knob 700 is located at the same height as or at a height that is similar to the height of the panel 3. In FIGS. 3 and 16, the panel 3 of the device in which rotary knob assembly 1 is disposed is illustrated by phantom lines. The rotary knob assembly 1 may be secured to the panel 3 by the plurality of fixing brackets 155 provided in the upper case 150.

Hereinafter, an example in which the rotary knob 700 is pressed in a state in which the rotary knob 700 projects as illustrated in FIG. 3, is described with reference to drawings.

If a user presses the top surface of the rotary knob 700, the rotary knob 700 moves down. When the rotary knob 700 is moved down, the connecting member 760 of the rotary knob 700 and the up-and-down moving sleeve 600 are also moved down along with the rotary knob 700. When the connecting member 760 of the rotary knob 700 is moved down, the plurality of ribs 762 of the connecting member 760 are moved down along the slots 462 of the connecting hole 460 of the rotary sleeve 400, and come into contact with the plurality of inclined teeth 414 that are provided in the top end of the lower rotary sleeve 410.

When a force is continuously applied to the rotary knob 700 in the downward direction, the ribs 762 may be lowered along the inclined surfaces 415 of the inclined teeth 414, and the rotary sleeve 400 may be rotated by a predetermined angle as much as the ribs 762 are lowered along the inclined surface 415. When the rotary sleeve 400 is rotated by the predetermined angle, the ribs 762 of the rotary knob 700 come out of the slots 462 of the rotary sleeve 400.

Accordingly, if the user removes the force applied to the rotary knob 700, as illustrated in FIG. 16, the ribs 762 of the rotary knob 700 may be caught by the receiving grooves 464 formed in the bottom surface of the upper portion 452 of the upper rotary sleeve 450 between the plurality of slots 462. Here, the rotary knob 700 may be caught by the rotary sleeve 400 so that the rotary knob 700 does not project outside the panel 3. In this example, the inclined surfaces 415 of the inclined teeth 414 of the rotary sleeve 400 are located below the ribs 762 of the rotary knob 700. Accordingly, if the rotary knob 700 is pressed again, the ribs 762 of the connecting member 760 of the rotary knob 700 may come into contact with the inclined surfaces 415 of the inclined teeth 414 of the rotary sleeve 400.

Also, when the up-and-down moving sleeve 600 is moved downward by the rotary knob 700, the pair of up-and-down cams 620 of the up-and-down moving sleeve 600 apply a force (arrow F1) to the cam groove 230 of the slide cam 200 in the downward direction as illustrated in FIG. 18. When the pair of up-and-down cams 620 applies a force to the side walls 220 forming the inclined cam groove 230 of the slide cam 200 in the downward direction, the slide cam 200 receives a force in the horizontal direction and is moved in the horizontal direction on the lower case 110. For example, if the up-and-down cams 620 of the up-and-down moving sleeve 600 apply a force to the side walls 220 forming the cam groove 230 of the slide cam 200 in the downward direction (arrow F1 in FIG. 18) due to the rotary knob 700, the slide cam 200 moves towards a right side (a direction of arrow A) in the FIG. 18 so that the up-and-down cam 620 of the up-and-down moving sleeve 600 is located from a P1 position of FIG. 18 to a P2 position of a lower side of the cam groove 230 as illustrated in FIG. 19.

In this example, if the rotary knob 700 is moved downward, the up-and-down moving sleeve 600 is moved downward, and the up-and-down cams 620 of the up-and-down moving sleeve 600 are moved downward along the cam groove 230 of the slide cam 200. Also, when the up-and-down cams 620 of the up-and-down moving sleeve 600 are located at the P2 position as shown in FIG. 19, the elastic member 300 provided on one side of the slide cam 200 is in a tension state. Here, even if the elastic member 300 is in a tension state, because the plurality of ribs 762 of the connecting member 760 of the rotary knob 700 are caught by the receiving grooves 464 of the rotary sleeve 400, the rotary knob 700 does not project towards the outside. Accordingly, the top surface of the rotary knob 700 is located at the same height as or at a height similar to the height of the panel 3 as illustrated in FIG. 16.

In an example of the rotary knob assembly 1 capable of up-and-down movement in which the lower case 110 is provided with the push-push latch 810 and the slide cam 200 is provided with the secondary fixing hook 820, when the slide cam 200 is moved in the horizontal direction by the lowering of the rotary knob 700, the secondary fixing hook 820 of the slide cam 200 may be coupled to the push-push latch 810 of the lower case 110 so that the slide cam 200 may be fixed more stably to the lower case 110. Accordingly, the rotary knob 700 can stably remain in the pressed state. In this example, the push-push latch 810 and the secondary fixing hook 820 are additionally disposed in order to secure the slide cam 200 more stably. Accordingly, as another example, the rotary knob assembly 1 capable of up and down movement may be formed by omitting the push-push latch 810 and the secondary fixing hook 820.

As illustrated in FIG. 16, in a state in which the top surface of the rotary knob 700 is located in the same height as the panel 3, if a user presses the top surface of the rotary knob 700, the rotary knob 700 projects from the panel 3.

For example, when the top surface of the rotary knob 700 is located at the same height as the panel 3 or at a height similar to the panel 3, as illustrated in FIG. 16, the ribs 762 of the connecting member 760 of the rotary knob 700 are located at the receiving grooves 464 of the rotary sleeve 400.

Also, the up-and-down cams 620 of the up-and-down moving sleeve 600 are located at the P2 position which is the lower part of the cam groove 230 of the slide cam 200 (see FIG. 19).

In this example, if the user presses the rotary knob 700, the connecting member 760 of the rotary knob 700 and the up-and-down moving sleeve 600 are moved downward together. Because the up-and-down cams 620 of the up-and-down moving sleeve 600 are moved from the P2 position to a P3 position as shown in FIG. 19, the rotary knob 700 can be moved down further from the state of FIG. 16. In this example, the ribs 762 of the connecting member 760 get out of the receiving grooves 464 of the upper rotary sleeve 450, and are in contact with the inclined surfaces 415 of the inclined teeth 414 of the lower rotary sleeve 410.

While the ribs 762 of the connecting member 760 are in contact with the inclined surfaces 415 of the inclined teeth 414 of the rotary sleeve 400, and if the force is continuously applied to the rotary knob 700 in the downward direction, the ribs 762 of the connecting member 760 push the inclined surfaces 415 of the inclined teeth 414 of the rotary sleeve 400 so that the rotary sleeve 400 is rotated by a predetermined angle. Accordingly, the slots 462 of the connecting hole 460 of the rotary sleeve 400 are located above the ribs 762 of the connecting member 760.

In this example, if the force applied to the rotary knob 700 is removed, the slide cam 200 moves in the horizontal direction by the elastic force of the elastic member 300 disposed between the lower case 110 and the slide cam 200. In the example of FIG. 19, when the slide cam 200 is moved in the left direction (i.e. in a direction of arrow B) by the elastic member 300, the up-and-down cams 620 of the up-and-down moving sleeve 600 receive a force (arrow F2) in the upward direction by the cam groove 230 of the slide cam 200 so that the up-and-down cams 620 are moved in the upward direction.

When the slide cam 200 is moved in the horizontal direction by the elastic member 300, the pinion gear 551 of the oil damper 550 that is engaged with the rack gear 240 of the slide cam 200 may be rotated. For example, while the rotary knob 700 is pressed as illustrated in FIG. 16, the rack gear 240 of the slide cam 200 is engaged with the pinion gear 551 of the oil damper 550 as illustrated in FIG. 21. In this example, the elastic member 300 is in a tensioned state. After that, when the rotary knob 700 is pressed, the slide cam 200 is moved toward the left side in FIG. 21 as indicated by arrow B by the elastic force of the elastic member 300 so as to be in the state as illustrated in FIG. 20. At this time, the elastic member 300 is a non-tensioned state. Accordingly, when the slide cam 200 is moved by the elastic member 300, the rotation of the pinion gear 551 engaged with the rack gear 240 is suppressed by the viscosity of the oil damper 550 so that the slide cam 200 is moved slowly with respect to the lower case 110. Accordingly, a moving speed of the slide cam 200 may be controlled by the oil damper 550.

When the up-and-down cams 620 of the up-and-down moving sleeve 600 are moved in an upward direction by the horizontal movement of the slide cam 200, the up-and-down moving sleeve 600 is also moved in the upward direction. When the up-and-down moving sleeve 600 is moved in the upward direction, the rotary knob 700 connected to the up-and-down moving sleeve 600 also is moved in the upward direction. Because the slide cam 200 for moving the up-and-down moving sleeve 600 upwardly is moved slowly in the horizontal direction by the oil damper 550, the up-and-down moving sleeve 600 is also slowly moved in the upward direction. Accordingly, because the up-and-down moving sleeve 600 is slowly moved in the upward direction, the rotary knob 700 is also slowly projected outside the panel 3.

The upward movement of the rotary knob 700 may be limited by the flange 720 of the rotary knob 700. For example, when the rotary knob 700 is raised, the flange 720 of the rotary knob 700 may be caught by the bottom surface 157 of the upper case 150 as illustrated in FIG. 3 so that the rising of the rotary knob 700 is limited. In this example, the connecting member 760 of the rotary knob 700 may be inserted in the connecting hole 460 of the rotary sleeve 400 as illustrated in FIG. 4. Accordingly, the plurality of ribs 762 of the connecting member 760 may be inserted in the plurality of slots 462 of the connecting hole 460.

Accordingly, when the connecting member 760 of the rotary knob 700 is rotated, the rotary sleeve 400 is also rotated together by the ribs 762 of the connecting member 760. In the state in which the rotary knob 700 projects from the panel 3 as illustrated in FIGS. 1 and 3, when the user rotates the rotary knob 700, the connecting member 760 of the rotary knob 700 may be rotated integrally with the rotary knob 700. When the connecting member 760 of the rotary knob 700 is rotated, the rotary sleeve 400 is also rotated together by the connecting member 760. However, even if the rotary knob 700 is rotated, the up-and-down moving sleeve 600 is not rotated. That is, even if the rotary sleeve 400 is rotated, the slide cam 200 and the lower case 110 are not rotated.

When the rotary sleeve 400 is rotated, the rotation shaft 910 of the variable volume 900 connected to the lower portion of the rotary sleeve 400 may be rotated integrally with the rotary sleeve 400. Accordingly, when the user rotates the rotary knob 700, the rotation shaft 910 of the variable volume 900 is rotated integrally with the rotary knob 700 such that the user can adjust the volume of the variable volume 900.

According to various exemplary embodiments, with the rotary knob assembly 1 capable of up and down movement, the rotary knob 700 of the rotary knob assembly 1 may be located inside a device such that an edge of the rotary knob is substantially or approximately flush with the outside of the case. Also, when pressed by a user, the rotary knob 700 may smoothly project outward from the device. Accordingly, it is possible to increase the degree of freedom in designing the device using the rotary knob assembly 1.

Also, a projection of the rotary knob 700 by the elastic member 300 and the slide cam 200 may be slowly performed due to the oil damper 550, thereby giving users a luxurious feel.

While the exemplary embodiments of the present disclosure have been described, additional variations and modifications of the exemplary embodiments may occur to those skilled in the art once they learn of the basic inventive concepts. Therefore, it is intended that the appended claims shall be construed to include both the above exemplary embodiments and all such variations and modifications that fall within the spirit and scope of the inventive concepts.

What is claimed is:

1. A rotary knob assembly capable of up and down movement, the rotary knob assembly comprising:

a lower case in which an oil damper is disposed;

a rotary sleeve rotatably disposed with respect to the lower case, the rotary sleeve comprising a connecting hole;

a slide cam that is configured to move linearly with respect to the lower case, the slide cam comprising a pair of cam grooves which are inclined with respect to the lower case and a sleeve hole through which the rotary sleeve passes;

an elastic member disposed between the slide cam and the lower case, the elastic member comprising a first end fixed to the lower case and a second end fixed to the slide cam;

an up-and-down moving sleeve that is configured to move up and down with respect to the rotary sleeve, the up-and-down moving sleeve comprising a pair of up-and-down cams that are inserted in the pair of cam grooves of the slide cam;

a rotary knob that is rotatably connected to the up-and-down moving sleeve, the rotary knob comprising a connecting member that is configured to be inserted in the connecting hole of the rotary sleeve; and an upper case connected to an upper side of the lower case, the upper case being configured to limit up and down movement of the rotary knob, wherein a moving speed of the slide cam is controlled by the oil damper.

2. The rotary knob assembly of claim 1, further comprising:

an output variable element comprising a rotation shaft connected to a bottom end of the rotary sleeve; and a printed circuit board in which the output variable element is disposed, the printed circuit board being fixed to the lower case.

3. The rotary knob assembly of claim 2, wherein the output variable element comprises a variable volume.

4. The rotary knob assembly of claim 1, wherein the oil damper comprises:

a pinion gear; and an oil tank rotatably supporting the pinion gear, the oil tank being filled with oil, wherein a rotation speed of the pinion gear is slowed by a viscosity resistance of the oil in the oil tank.

5. The rotary knob assembly of claim 4, wherein the slide cam comprises a rack gear that is formed parallel to a moving direction of the slide cam and is engaged with the pinion gear of the oil damper.

6. The rotary knob assembly of claim 1, wherein the rotary knob comprises:

an upper rotary knob comprising a hollow cylindrical shape with a bottom, and a lower rotary knob comprising a hollow cylindrical shape, wherein the connecting member is formed at a center of the bottom of the upper rotary knob, and the upper rotary knob is detachably coupled to the lower rotary knob.

7. The rotary knob assembly of claim 6, wherein the lower rotary knob further comprises a flange that is caught by a bottom surface of the upper case.

8. The rotary knob assembly of claim 6, wherein the up-and-down moving sleeve comprises, a sleeve cap comprising a hollow cylindrical shape, the sleeve cap including a sleeve flange caught by a top end of the lower rotary knob; and a sleeve body comprising a hollow cylindrical shape, the sleeve body coupled to the sleeve cap, wherein the pair of up-and-down cams are formed in a lower portion of a side surface of the sleeve body.

9. The rotary knob assembly of claim 1, wherein the rotary sleeve comprises:

an upper rotary sleeve comprising the connecting hole and a receiving space in which the connecting member of the rotary knob is received; and a lower rotary sleeve coupled to the upper rotary sleeve and comprising a fixing groove in which a rotating object is inserted.

10. The rotary knob assembly of claim 9, wherein the rotary sleeve is rotatably disposed in the lower case by a fixing ring.

11. The rotary knob assembly of claim 9, wherein a plurality of inclined teeth are concentrically formed at a top end of the lower rotary sleeve.

12. The rotary knob assembly of claim 11, wherein the connecting hole of the upper rotary sleeve comprises a central hole and a plurality of slots extending from the central hole, and the connecting member of the rotary knob comprises a body inserted in the central hole and a plurality of ribs that extend from the body and that are inserted in the slots.

13. The rotary knob assembly of claim 12, wherein a bottom surface of the upper rotary sleeve is provided with receiving grooves in which the ribs of the rotary knob are received.

14. The rotary knob assembly of claim 1, further comprising an elastic member which is disposed between the rotary knob and the rotary sleeve, and which is configured to elastically support the rotary knob.

15. The rotary knob assembly of claim 1, wherein, in response to the rotary knob being pressed once, the connecting member of the rotary knob is caught by the rotary sleeve so that the rotary sleeve remains in a pressed state.

16. The rotary knob assembly of claim 15, wherein, in response to the rotary knob being pressed again, the connecting member of the rotary knob is configured to project out of the rotary sleeve and project to an original position.

17. The rotary knob assembly of claim 1, wherein the lower case is provided with a pair of supporting brackets to support an up and down movement of the up-and-down moving sleeve.

18. The rotary knob assembly of claim 1, wherein the lower case comprises a push-push latch, and a secondary fixing hook which is coupled to or separated from the push-push latch according to a movement of the slide cam, is formed in the slide cam.

19. A rotary knob assembly comprising:

a case comprising a knob through hole;

a rotary knob housed in the case and configured to protrude from the knob through hole;

an elastic member configured to apply an elastic force to the rotary knob; and an oil damper included in the case, the oil damper being configured to control the speed at which the rotary knob protrudes from and returns to the case, wherein, in response to the rotary knob being pressed by a user, the elastic member is configured to cause the rotary knob to protrude outwardly from the case by a predetermined amount, and in response to the rotary knob being pressed again by the user, the elastic member is configured to cause the rotary knob to return into the case such that an edge of the rotary knob is approximately flush with the case.

* * * * *